US011001934B2

(12) United States Patent
Banik, II et al.

(10) Patent No.: US 11,001,934 B2
(45) Date of Patent: May 11, 2021

(54) METHODS AND APPARATUS FOR FLOW ISOLATION AND FOCUSING DURING ELECTROPLATING

(71) Applicant: Lam Research Corporation, Fremont, CA (US)

(72) Inventors: Stephen J. Banik, II, Portland, OR (US); Bryan L. Buckalew, Tualatin, OR (US); Aaron Berke, Portland, OR (US); James Isaac Fortner, Newberg, OR (US); Justin Oberst, Beaverton, OR (US); Steven T. Mayer, Aurora, OR (US); Robert Rash, West Linn, OR (US)

(73) Assignee: Lam Research Corporation, Fremont, CA (US)

( * ) Notice: Subject to any disclaimer, the term of this patent is extended or adjusted under 35 U.S.C. 154(b) by 353 days.

(21) Appl. No.: 16/101,291

(22) Filed: Aug. 10, 2018

(65) Prior Publication Data

US 2019/0055665 A1 Feb. 21, 2019

Related U.S. Application Data

(60) Provisional application No. 62/548,116, filed on Aug. 21, 2017.

(51) Int. Cl.

| | |
|---|---|
| ***C25D 17/00*** | (2006.01) |
| ***C25D 21/10*** | (2006.01) |
| ***C25D 7/12*** | (2006.01) |

(52) U.S. Cl.

CPC ..... *C25D 17/001* (2013.01); *C25D 7/123* (2013.01); *C25D 17/002* (2013.01);
(Continued)

(58) Field of Classification Search

CPC ..... C25D 17/001; C25D 21/10
See application file for complete search history.

(56) References Cited

U.S. PATENT DOCUMENTS 3,652,442 A 3/1972 Powers et al.
3,706,651 A 12/1972 Leland
(Continued)

FOREIGN PATENT DOCUMENTS

CN 1353778 A 6/2002
CN 1463467 A 12/2003
(Continued)

OTHER PUBLICATIONS

US Office Action dated Oct. 26, 2007 issued in U.S. Appl. No. 11/040,359.
(Continued)

*Primary Examiner* — Ciel P Contreras
(74) *Attorney, Agent, or Firm* — Weaver Austin Villeneuve & Sampson LLP

(57) ABSTRACT

Various embodiments described herein relate to methods and apparatus for electroplating material onto a semiconductor substrate. In some cases, one or more membrane may be provided in contact with an ionically resistive element to minimize the degree to which electrolyte passes backwards from a cross flow manifold, through the ionically resistive element, and into an ionically resistive element manifold during electroplating. The membrane may be designed to route electrolyte in a desired manner in some embodiments. In these or other cases, one or more baffles may be provided in the ionically resistive element manifold to reduce the degree to which electrolyte is able to bypass the cross flow manifold by flowing back through the ionically resistive element and across the electroplating cell within the ioni-
(Continued)

cally resistive element manifold. These techniques can be used to improve the uniformity of electroplating results.

20 Claims, 18 Drawing Sheets

(52) U.S. Cl.
CPC ..... *C25D 17/004* (2013.01); *C25D 17/005* (2013.01); *C25D 17/008* (2013.01); *C25D 21/10* (2013.01)

(56) References Cited

U.S. PATENT DOCUMENTS 3,862,891 A 1/1975 Smith
4,033,833 A 7/1977 Bestel et al.
4,082,638 A 4/1978 Jumer
4,240,886 A 12/1980 Hodges et al.
4,272,335 A 6/1981 Combs
4,304,641 A 12/1981 Grandia et al.
4,427,520 A 1/1984 Bahnsen et al.
4,469,564 A 9/1984 Okinaka et al.
4,545,877 A 10/1985 Hillis
4,604,177 A 8/1986 Sivilotti
4,604,178 A 8/1986 Flegener et al.
4,605,482 A 8/1986 Shirgami et al.
4,633,893 A 1/1987 McConnell
4,696,729 A 9/1987 Santini
4,738,272 A 4/1988 McConnell
4,828,654 A 5/1989 Reed
4,856,544 A 8/1989 McConnell
4,906,346 A 3/1990 Hadersbeck et al.
4,931,149 A 6/1990 Stierman et al.
4,933,061 A 6/1990 Kulkarni et al.
5,039,381 A 8/1991 Mullarkey
5,078,852 A 1/1992 Yee et al.
5,096,550 A 3/1992 Mayer et al.
5,146,136 A 9/1992 Ogura et al.
5,156,730 A 10/1992 Bhatt et al.
5,162,079 A 11/1992 Brown
5,217,586 A 6/1993 Datta et al.
5,316,642 A 5/1994 Young, Jr. et al.
5,368,711 A 11/1994 Poris
5,391,285 A 2/1995 Lytle et al.
5,421,987 A 6/1995 Tzanavaras et al.
5,443,707 A 8/1995 Mori
5,472,592 A 12/1995 Lowery
5,476,578 A 12/1995 Forand
5,498,325 A 3/1996 Nishimura et al.
5,516,412 A 5/1996 Andricacos et al.
5,567,300 A 10/1996 Datta et al.
5,660,699 A 8/1997 Saito et al.
5,723,028 A 3/1998 Poris
5,744,019 A 4/1998 Ang
5,935,402 A 8/1999 Fanti
6,004,440 A 12/1999 Hanson et al.
6,022,465 A 2/2000 Ting et al.
6,027,631 A 2/2000 Broadbent
6,080,291 A 6/2000 Woodruff et al.
6,106,687 A 8/2000 Edelstein
6,126,798 A 10/2000 Reid et al.
6,132,587 A 10/2000 Jorne et al.
6,132,805 A 10/2000 Moslehi
6,179,983 B1 1/2001 Reid et al.
6,193,860 B1 2/2001 Weling
6,228,231 B1 5/2001 Uzoh
6,251,255 B1 6/2001 Copping et al.
6,254,742 B1 7/2001 Hanson et al.
6,261,433 B1 7/2001 Landau
6,368,475 B1 4/2002 Hanson et al.
6,391,166 B1 5/2002 Wang
6,391,188 B1 5/2002 Goosey
6,395,152 B1 5/2002 Wang
6,398,926 B1 6/2002 Mahneke
6,402,923 B1 6/2002 Mayer et al.
6,431,908 B1 8/2002 Beck et al.
6,454,918 B1 9/2002 Sakaki
6,497,801 B1 12/2002 Woodruff et al.
6,514,570 B1 2/2003 Matsuyama et al.
6,521,102 B1 2/2003 Dordi
6,527,920 B1 3/2003 Jackson et al.
6,551,483 B1 4/2003 Mayer et al.
6,627,051 B2 9/2003 Berner et al.
6,632,335 B2 10/2003 Kunisawa et al.
6,755,946 B1 6/2004 Patton et al.
6,755,954 B2 6/2004 Mayer et al.
6,773,571 B1 8/2004 Mayer et al.
6,800,187 B1 10/2004 Reid et al.
6,821,407 B1 11/2004 Reid et al.
6,843,855 B2 1/2005 Verhaverbeke
6,869,515 B2 3/2005 Cohen
6,890,416 B1 5/2005 Mayer et al.
6,919,010 B1 7/2005 Mayer et al.
6,921,468 B2 7/2005 Graham et al.
6,964,792 B1 11/2005 Mayer et al.
7,070,686 B2 7/2006 Contolini et al.
7,169,705 B2 1/2007 Ide et al.
D544,452 S 6/2007 Nakamura et al.
D548,705 S 8/2007 Hayashi
D552,565 S 10/2007 Nakamura et al.
D553,104 S 10/2007 Oohashi et al.
7,387,131 B2 6/2008 Kuroda et al.
D587,222 S 2/2009 Sasaki et al.
7,622,024 B1 11/2009 Mayer et al.
7,641,776 B2 1/2010 Nagar et al.
D609,652 S 2/2010 Nagasaka et al.
D609,655 S 2/2010 Sugimoto
7,670,465 B2 3/2010 Yang et al.
D614,593 S 4/2010 Lee et al.
7,837,841 B2 11/2010 Chen et al.
7,854,828 B2 12/2010 Reid et al.
7,935,240 B2 5/2011 Singh et al.
7,967,969 B2 6/2011 Mayer et al.
D648,289 S 11/2011 Mayer et al.
8,262,871 B1 9/2012 Mayer et al.
8,308,931 B2 11/2012 Reid et al.
8,623,193 B1 1/2014 Mayer et al.
8,795,480 B2 8/2014 Mayer et al.
9,394,620 B2 7/2016 Mayer et al.
9,449,808 B2 9/2016 Buckalew et al.
9,464,361 B2 10/2016 Mayer et al.
9,523,155 B2 12/2016 Mayer et al.
9,624,592 B2 4/2017 Abraham et al.
9,677,190 B2 6/2017 Kim et al.
9,834,852 B2 12/2017 Mayer et al.
9,899,230 B2 2/2018 Buckalew et al.
10,094,034 B2 10/2018 Graham et al.
10,190,230 B2 1/2019 Abraham et al.
10,233,556 B2 3/2019 Graham et al.
10,364,505 B2 7/2019 Thorkelsson et al.
10,662,545 B2 5/2020 Mayer et al.
10,781,527 B2 9/2020 Banik, II et al.
2002/0017456 A1 2/2002 Graham et al.
2002/0062839 A1 5/2002 Verhaverbeke et al.
2002/0066464 A1 6/2002 Bergman
2002/0084189 A1 7/2002 Wang et al.
2002/0088708 A1 7/2002 Sakaki
2002/0119671 A1 8/2002 Lee
2002/0125141 A1 9/2002 Wilson et al.
2002/0164840 A1 11/2002 Lu et al.
2002/0166773 A1 11/2002 Cohen
2003/0017647 A1 1/2003 Kwon et al.
2003/0019755 A1 1/2003 Hey et al.
2003/0029527 A1 2/2003 Yajima et al.
2003/0038035 A1 2/2003 Wilson et al.
2003/0075451 A1 4/2003 Kanda
2003/0102210 A1 6/2003 Woodruff et al.
2003/0201166 A1 10/2003 Zheng et al.
2004/0000487 A1 1/2004 Bonkass et al.
2004/0053147 A1 3/2004 Ito
2004/0084301 A1 5/2004 Dordi et al.
2004/0118694 A1 6/2004 Yang et al.
2004/0149584 A1 8/2004 Nagai et al.
2004/0163963 A1 8/2004 Uzoh et al.

(56) References Cited

U.S. PATENT DOCUMENTS

| | | | | |
|---|---|---|---|---|
| 2004/0168926 | A1 | 9/2004 | Basol et al. | |
| 2004/0231989 | A1 | 11/2004 | Kobata et al. | |
| 2004/0256238 | A1 | 12/2004 | Suzuki et al. | |
| 2005/0003737 | A1 | 1/2005 | Montierth et al. | |
| 2005/0045488 | A1 | 3/2005 | Paneccasio et al. | |
| 2005/0053874 | A1 | 3/2005 | Yoshihara et al. | |
| 2005/0056538 | A1 | 3/2005 | Kovarsky et al. | |
| 2005/0145482 | A1 | 7/2005 | Suzuki et al. | |
| 2005/0145499 | A1 | 7/2005 | Kovarsky et al. | |
| 2005/0161336 | A1 | 7/2005 | Woodruff et al. | |
| 2005/0181252 | A1 | 8/2005 | Risen et al. | |
| 2005/0205429 | A1 | 9/2005 | Gebhart et al. | |
| 2006/0038182 | A1 | 2/2006 | Rogers et al. | |
| 2006/0054181 | A1 | 3/2006 | Rayandayan et al. | |
| 2006/0243598 | A1 | 11/2006 | Singh et al. | |
| 2007/0015080 | A1 | 1/2007 | Toukhy et al. | |
| 2007/0029193 | A1 | 2/2007 | Brcka | |
| 2007/0068819 | A1 | 3/2007 | Singh et al. | |
| 2007/0175752 | A1 | 8/2007 | Yang et al. | |
| 2010/0032303 | A1 | 2/2010 | Reid et al. | |
| 2010/0032304 | A1 | 2/2010 | Mayer et al. | |
| 2010/0032310 | A1 | 2/2010 | Reid et al. | |
| 2010/0035192 | A1 | 2/2010 | Ando et al. | |
| 2010/0044236 | A1 | 2/2010 | Mayer et al. | |
| 2010/0116672 | A1 | 5/2010 | Mayer et al. | |
| 2010/0243462 | A1 | 9/2010 | Cohen | |
| 2011/0031112 | A1 | 2/2011 | Birang et al. | |
| 2012/0000786 | A1 | 1/2012 | Mayer et al. | |
| 2012/0104350 | A1 | 5/2012 | Himeno et al. | |
| 2012/0138471 | A1* | 6/2012 | Mayer | C25D 21/12 205/170 |
| 2012/0258408 | A1 | 10/2012 | Mayer et al. | |
| 2012/0261254 | A1 | 10/2012 | Reid et al. | |
| 2013/0137242 | A1* | 5/2013 | He | H01L 21/02697 438/468 |
| 2013/0313123 | A1 | 11/2013 | Abraham et al. | |
| 2014/0183049 | A1 | 7/2014 | Mayer et al. | |
| 2014/0216940 | A1 | 8/2014 | Wang et al. | |
| 2014/0299476 | A1 | 10/2014 | Yasuda et al. | |
| 2014/0299477 | A1 | 10/2014 | Mayer et al. | |
| 2014/0299478 | A1 | 10/2014 | Mayer et al. | |
| 2014/0357089 | A1 | 12/2014 | Buckalew et al. | |
| 2015/0129418 | A1 | 5/2015 | Keigler et al. | |
| 2016/0002076 | A1 | 1/2016 | Jha et al. | |
| 2016/0215408 | A1 | 7/2016 | Kagajwala et al. | |
| 2016/0265132 | A1 | 9/2016 | Graham et al. | |
| 2016/0273119 | A1 | 9/2016 | He et al. | |
| 2016/0343582 | A1 | 11/2016 | Buckalew et al. | |
| 2016/0376722 | A1 | 12/2016 | Mayer et al. | |
| 2017/0029973 | A1 | 2/2017 | Mayer et al. | |
| 2017/0058417 | A1 | 3/2017 | Graham et al. | |
| 2017/0175286 | A1 | 6/2017 | Abraham et al. | |
| 2017/0191180 | A1* | 7/2017 | Bergman | C25D 21/10 |
| 2017/0342583 | A1 | 11/2017 | Thorkelsson et al. | |
| 2017/0342590 | A1 | 11/2017 | Thorkelsson et al. | |
| 2018/0105949 | A1 | 4/2018 | Mayer et al. | |
| 2018/0258546 | A1 | 9/2018 | Graham et al. | |
| 2019/0085479 | A1 | 3/2019 | Banik, II et al. | |
| 2019/0301042 | A1 | 10/2019 | Thorkelsson et al. | |

FOREIGN PATENT DOCUMENTS

| | | | |
|---|---|---|---|
| CN | 1551931 | A | 12/2004 |
| CN | 101056718 | A | 10/2007 |
| CN | 101220500 | A | 7/2008 |
| CN | 101736376 | A | 6/2010 |
| CN | 102330140 | A | 1/2012 |
| CN | 201130081716.6 | | 4/2012 |
| CN | 102459717 | A | 5/2012 |
| CN | 102719865 | A | 10/2012 |
| CN | 102732924 | A | 10/2012 |
| CN | 103866374 | A | 6/2014 |
| EP | 0 037 325 | | 3/1981 |
| EP | 0 233 184 | | 8/1987 |
| EP | 1 391 540 | | 2/2004 |
| EP | 1 538 662 | | 6/2005 |
| GB | 2 176 908 | | 1/1987 |
| GB | 2 206 733 | | 1/1989 |
| JP | 59-162298 | | 9/1984 |
| JP | 09-53197 | | 2/1997 |
| JP | 10-036997 | A | 10/1998 |
| JP | 2000-87299 | A | 3/2000 |
| JP | 2001-064795 | A | 3/2001 |
| JP | 2001-316887 | | 11/2001 |
| JP | 2002-289568 | | 10/2002 |
| JP | 2003-268591 | | 9/2003 |
| JP | 2004-068158 | A | 3/2004 |
| JP | 2004-250785 | A | 9/2004 |
| JP | 2005-344133 | A | 12/2005 |
| KR | 10-2003-0065388 | A | 8/2003 |
| KR | 10-2006-0048645 | A | 5/2006 |
| KR | 10-0707121 | | 4/2007 |
| KR | 10-2012-0003405 | A | 1/2012 |
| KR | 10-2012-0029468 | A | 3/2012 |
| KR | 10-2012-0036030 | | 4/2012 |
| KR | 0657600 | | 8/2012 |
| TW | 200302519 | | 8/2003 |
| TW | 591122 | B | 6/2004 |
| TW | 201204877 | A | 2/2012 |
| TW | D148167 | | 7/2012 |
| TW | 201313968 | A1 | 4/2013 |
| TW | 201437439 | A | 10/2014 |
| WO | WO 87/00094 | | 1/1987 |
| WO | WO 1999/041434 | | 8/1999 |
| WO | WO 00/61837 | | 10/2000 |
| WO | WO 01/68952 | A1 | 9/2001 |
| WO | WO 02/01609 | | 1/2002 |
| WO | WO 2003/018879 | | 6/2003 |
| WO | WO 2004/114372 | | 12/2004 |
| WO | WO 2007/128659 | | 11/2007 |
| WO | WO 2010/144330 | | 12/2010 |

OTHER PUBLICATIONS

US Final Office Action dated Jul. 25, 2008 issued in U.S. Appl. No. 11/040,359.

US Office Action dated Jan. 8, 2009 issued in U.S. Appl. No. 11/040,359.

US Notice of Allowance dated Jul. 20, 2009 issued in U.S. Appl. No. 11/040,359.

US Office Action dated Oct. 6, 2010 issued in U.S. Appl. No. 12/578,310.

US Notice of Allowance dated Mar. 4, 2011 issued in U.S. Appl. No. 12/578,310.

US Office Action dated Oct. 5, 2012 issued in U.S. Appl. No. 13/110,759.

US Office Action dated Sep. 19, 2011 issued in U.S. Appl. No. 12/291,356.

US Final Office Action dated Feb. 27, 2012 issued in U.S. Appl. No. 12/291,356.

US Notice of Allowance dated Jul. 27, 2012 issued in U.S. Appl. No. 12/291,356.

US Office Action dated Jun. 24, 2011 issued in U.S. Appl. No. 12/481,503.

US Final Office Action dated Mar. 1, 2012 issued in U.S. Appl. No. 12/481,503.

US Office Action dated Jul. 9, 2012 issued in U.S. Appl. No. 12/481,503.

US Final Office Action dated Dec. 19, 2012 issued in U.S. Appl. No. 12/481,503.

US Office Action dated Jun. 24, 2011 issued in U.S. Appl. No. 12/606,030.

US Final Office Action dated Mar. 1, 2012 issued in U.S. Appl. No. 12/606,030.

US Office Action dated Jul. 13, 2012 issued in U.S. Appl. No. 12/606,030.

US Final Office Action dated Dec. 17, 2012 issued in U.S. Appl. No. 12/606,030.

(56) References Cited

OTHER PUBLICATIONS

US Notice of Allowance dated Aug. 10, 2011 issued in U.S. Appl. No. 29/377,521.
US Office Action dated Jun. 26, 2013 issued in U.S. Appl. No. 13/172,642.
US Final Office Action dated Jan. 15, 2014 issued in U.S. Appl. No. 13/172,642.
US Notice of Allowance dated Mar. 27, 2014 issued in U.S. Appl. No. 13/172,642.
US Office Action dated Jan. 14, 2016 issued in U.S. Appl. No. 14/309,723.
US Notice of Allowance dated Jun. 9, 2016 issued in U.S. Appl. No. 14/309,723.
US Notice of Allowability dated Sep. 13, 2016 issued in U.S. Appl. No. 14/309,723.
US Office Action dated Apr. 13, 2018 issued in U.S. Appl. No. 15/261,244.
US Office Action dated Nov. 2, 2015 issued in U.S. Appl. No. 13/893,242.
US Office Action dated May 18, 2016 issued in U.S. Appl. No. 13/893,242.
US Notice of Allowance dated Dec. 8, 2016 issued in U.S. Appl. No. 13/893,242.
US Office Action dated Feb. 15, 2018 issued in U.S. Appl. No. 15/448,472.
US Office Action dated Aug. 18, 2015 issued in U.S. Appl. No. 14/308,258.
US Notice of Allowance dated Jan. 12, 2016 issued in U.S. Appl. No. 14/308,258.
US Office Action dated Feb. 1, 2016 issued in U.S. Appl. No. 14/103,395.
US Notice of Allowance dated Jul. 15, 2016 issued in U.S. Appl. No. 14/103,395.
US Notice of Allowance (Corrected Notice of Allowability) dated Aug. 24, 2016 issued in U.S. Appl. No. 14/103,395.
US Notice of Allowance (Corrected Notice of Allowability) dated Nov. 16, 2016 issued in U.S. Appl. No. 14/103,395.
US Office Action dated Apr. 6, 2017 issued in U.S. Appl. No. 15/291,543.
US Notice of Allowance dated Jul. 28, 2017 issued in U.S. Appl. No. 15/291,543.
US Office Action dated Oct. 15, 2014 issued in U.S. Appl. No. 13/904,283.
US Notice of Allowance dated May 5, 2015 issued in U.S. Appl. No. 13/904,283.
US Notice of Allowance dated Feb. 1, 2016 issued in U.S. Appl. No. 13/904,283.
US Notice of Allowance dated Aug. 2, 2016 issued in U.S. Appl. No. 13/904,283.
US Office Action dated May 26, 2017 issued in U.S. Appl. No. 15/231,623.
US Notice of Allowance dated Sep. 20, 2017 issued in U.S. Appl. No. 15/231,623.
US Office Action dated Feb. 9, 2018 issued in U.S. Appl. No. 14/924,124.
US Notice of Allowance dated Jun. 12, 2018 issued in U.S. Appl. No. 14/924,124.
PCT International Search Report and Written Opinion dated Jan. 12, 2011 issued in Application No. PCT/US2010/037520.
Chinese Office Action dated Jul. 19, 2011 issued in Application No. CN 201130081716.6.
Taiwan Office Action dated Nov. 28, 2011 issued in Application No. TW 100301923.
Korean Office Action dated Apr. 20, 2012 issued in Application No. KR 2011-0012881.
Chinese First Office Action dated Jan. 20, 2015 issued in Application No. CN 201110192296.8.
Chinese Second Office Action dated Sep. 23, 2015 issued in Application No. CN 201110192296.8.
Chinese Third Office Action dated Jan. 15, 2016 issued in Application No. CN 201110192296.8.
Chinese Fourth Office Action dated May 5, 2016 issued in Application No. CN 201110192296.8.
Chinese First Office Action dated Feb. 5, 2018 issued in Application No. CN 201610916461.2.
Korean Office Action dated Mar. 14, 2017 issued in Application No. KR 10-2011-0066023.
Korean Office Action dated Aug. 11, 2017 issued in Application No. KR 10-2017-0060181.
Korean First Office Action dated Mar. 5, 2018 issued in Application No. KR 10-2017-0168351.
Taiwan Office Action dated Apr. 8, 2015 issued in Application No. TW 100123415.
Taiwan Office Action and Search Report dated Mar. 4, 2016 issued in Application No. TW 104127539.
Taiwan Office Action and Search Report dated Aug. 5, 2016 issued in Application No. TW 102117113.
Austrian Office Action dated Aug. 14, 2014 issued in Application No. A50817/2013.
Austrian Search Report dated Dec. 5, 2014 issued in Application No. A50817/2013.
Chinese First Office Action dated Nov. 26, 2015 issued in Application No. CN 201310683415.9.
Chinese Second Office Action dated Aug. 3, 2016 issued in Application No. CN 201310683415.9.
Chinese First Office Action dated May 24, 2018 issued in Application No. CN 201610966878.X.
Taiwan Examination and Search Report dated Apr. 14, 2017 issued in Application No. TW 102145866.
Taiwan First Office Action dated Mar. 21, 2018 issued in Application No. TW 106132551.
Japanese First Office Action dated Dec. 21, 2017 issued in Application No. JP 2013-257021.
Taiwan Notice of Allowance and Search Report dated Oct. 31, 2017 issued in Application No. TW 103118470.
Taiwan First Office Action dated May 31, 2018 issued in Application No. TW 106141265.
Chinese First Office Action dated Mar. 2, 2018 issued in Application No. CN 201610756695.5.
International Search Report and Written Opinion dated Jun. 15, 2018 issued in Application No. PCT/US2018/021387.
Akire et al., (Nov. 1982) "High-Speed Selective Electroplating with Single Circular Jets," *J. Electrochem. Soc.: Electrochemical Science and Technology*, 129(11):2424-2432.
*Electrochemical Methods: Fundamentals and Applications*, Bard & Faulkner eds. Chapter 8, Dec. 2000, pp. 280-292.
Fang et al. (2004) "Uniform Copper Electroplating on Resistive Substrates," Abs. 167, 205th Meeting, The Electrochemical Society, Inc., 1 page.
Lowenheim, (1978) "Electroplating," *Sponsored by the American Electroplaters' Society*, McGraw-Hill Book Company, New York, p. 139.
Malmstadt et al., (1994) "Microcomputers and Electronic Instrumentation: Making the Right Connections," American Chemical Society, p. 255.
"Release of Sabre™ electrofill tool with HRVA by Novellus Systems, Inc." dated prior to Jun. 2011 (3 pages).
Schwartz, Daniel T. et al., (1987) "Mass-Transfer Studies in a Plating Cell with a Reciprocating Paddle," *Journal of the Electrochemical Society*, 134(7):1639-1645.
Wilson, Gregory J. et al., (2005) "Unsteady Numerical Simulation of the Mass Transfer within a Reciprocating Paddle Electroplating Cell," *Journal of the Electrochemical Society*, 152(6):C356-C365.
U.S. Appl. No. 15/455,011, filed Mar. 9, 2017, Graham et al.
U.S. Appl. No. 15/707,805, filed Sep. 18, 2017, Banik et al.
U.S. Appl. No. 15/846,029, filed Dec. 18, 2017, Buckalew et al.
Chinese First Office Action dated Oct. 8, 2018 issued in Application No. CN 201710374684.5.
Chinese Second Office Action dated Dec. 28, 2018 issued in Application No. CN 201610756695.5.
Chinese Second Office Action dated Feb. 19, 2019 issued in Application No. CN 201610966878.X.

(56) References Cited

OTHER PUBLICATIONS

Chinese Second Office Action dated Jul. 2, 2019 issued in Application No. CN 201710374684.5.
International Preliminary Report on Patentability dated Apr. 2, 2020 issued in Application No. PCT/US2018/051447.
International Preliminary Report on Patentability dated Mar. 5, 2020 issued in Application No. PCT/US2018/000362.
International Preliminary Report on Patentability dated Sep. 19, 2019 issued in Application No. PCT/US2018/021387.
International Search Report and Written Opinion dated Jan. 10, 2019 issued in Application No. PCT/US2018/051447.
International Search Report and Written Opinion dated Jan. 29, 2019 issued in Application No. PCT/US2018/000362.
Japanese Second Office Action dated Oct. 2, 2018 issued in Application No. JP 2013-257021.
Korean Decision for Grant of Patent dated May 6, 2020 issued in Application No. KR 10-2013-0054677.
Korean Decision for Grant of Patent dated Nov. 10, 2020 issued in KR Application No. 2013-0155069.
Korean Decision for Grant of Patent dated Sep. 21, 2018 issued in Application No. KR 10-2017-0168351.
Korean First Office Action dated Jan. 8, 2020 issued in Application No. KR 10-2013-0054677.
Korean First Office Action dated Nov. 1, 2020 issued in KR Application No. 10-2014-0065406.
Korean Office Action dated May 19, 2020 issued in KR Application No. 2013-0155069.
Taiwanese First Office Action dated Feb. 20, 2020 issued in Application No. TW 105126685.
Taiwanese First Office Action dated Oct. 26, 2020 issued in Application No. TW 106116801.
US Final Office Action dated Oct. 16, 2018 issued in U.S. Appl. No. 15/261,24.
US Notice of Allowance dated Jan. 31, 2020 issued in U.S. Appl. No. 15/799,903.
US Notice of Allowance dated Mar. 8, 2019 issued in U.S. Appl. No. 15/225,716.
US Notice of Allowance dated May 28, 2020 issued in U.S. Appl. No. 15/707,805.
US Notice of Allowance dated Oct. 30, 2018 issued in U.S. Appl. No. 15/161,081.
US Notice of Allowance dated Sep. 14, 2018 issued in U.S. Appl. No. 15/448,472.
US Office Action dated Dec. 31, 2018 issued in U.S. Appl. No. 15/455,011.
US Office Action dated Jul. 10, 2019 issued in U.S. Appl. No. 15/799,903.
US Office Action dated Oct. 17, 2019 issued in U.S. Appl. No. 15/707,805.
US Office Action dated Oct. 25, 2018 issued in U.S. Appl. No. 15/225,716.
US Office Action dated Oct. 30, 2018 issued in U.S. Appl. No. 15/413,252.
US Office Action dated Sep. 15, 2020 issued in U.S. Appl. No. 16/432,398.
U.S. Notice of Allowance dated Jan. 29, 2021 issued in U.S. Appl. No. 16/432,398.

* cited by examiner

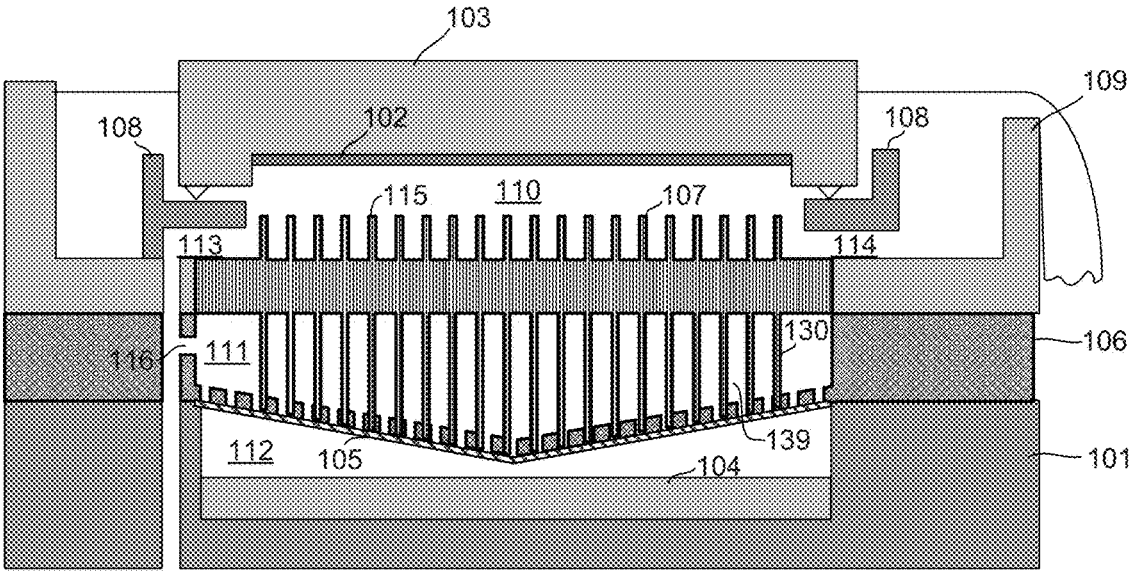
FIG. 5A
FIG. 5B
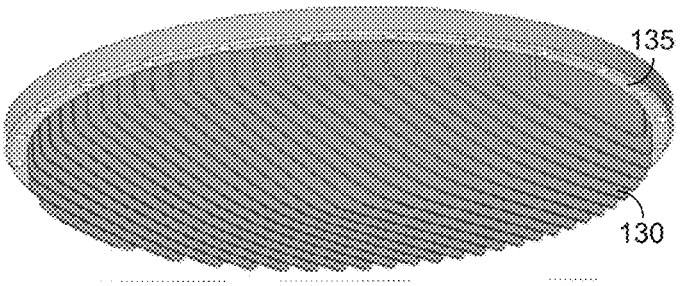
FIG. 5C
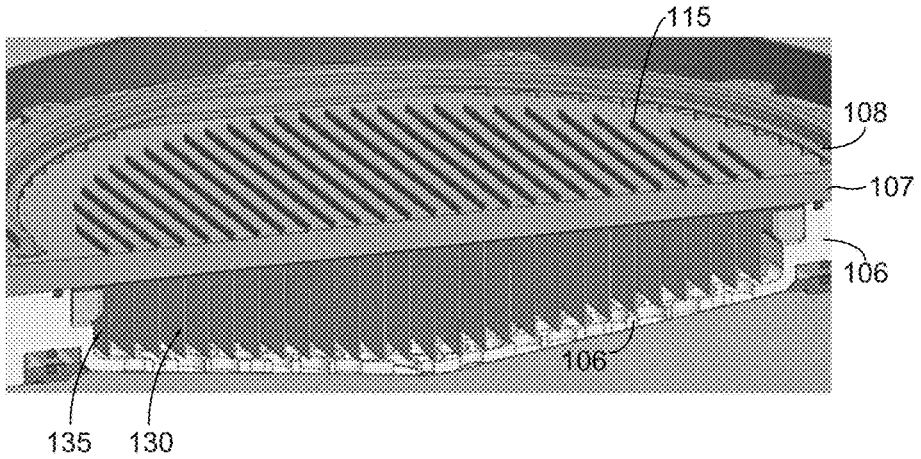

METHODS AND APPARATUS FOR FLOW ISOLATION AND FOCUSING DURING ELECTROPLATING

CROSS REFERENCE TO RELATED APPLICATIONS

This application claims benefit of U.S. Provisional Patent Application Ser. No. 62/548,116, filed Aug. 21, 2017, and titled "METHODS AND APPARATUS FOR FLOW ISOLATION AND FOCUSING DURING ELECTROPLATING," which is herein incorporated by reference in its entirety and for all purposes.

FIELD

Embodiments herein relate to methods and apparatus for electroplating material onto substrates. The substrates are typically semiconductor substrates and the material is typically metal.

BACKGROUND

The disclosed embodiments relate to methods and apparatus for controlling electrolyte hydrodynamics during electroplating. More particularly, methods and apparatus described herein are particularly useful for plating metals onto semiconductor wafer substrates, such as through resist plating of small microbumping features (e.g., copper, nickel, tin and tin alloy solders) having widths less than, e.g., about 50 μm, and copper through silicon via (TSV) features.

Electrochemical deposition is now poised to fill a commercial need for sophisticated packaging and multichip interconnection technologies known generally and colloquially as wafer level packaging (WLP) and through silicon via (TSV) electrical connection technology. These technologies present their own very significant challenges due in part to the generally larger feature sizes (compared to Front End of Line (FEOL) interconnects) and high aspect ratios.

Depending on the type and application of the packaging features (e.g., through chip connecting TSV, interconnection redistribution wiring, or chip to board or chip bonding, such as flip-chip pillars), plated features are usually, in current technology, greater than about 2 micrometers and are typically about 5-100 micrometers in their principal dimension (for example, copper pillars may be about 50 micrometers). For some on-chip structures such as power busses, the feature to be plated may be larger than 100 micrometers. The aspect ratios of the WLP features are typically about 1:1 (height to width) or lower, though they can range as high as perhaps about 2:1 or so, while TSV structures can have very high aspect ratios (e.g., in the neighborhood of about 20:1).

SUMMARY

Certain embodiments herein relate to methods and apparatus for electroplating a substrate. The substrate is substantially planar, and may be a semiconductor substrate.

In one aspect of the embodiments herein, an electroplating apparatus is provided, the apparatus including: (a) a plating chamber configured to contain an electrolyte and an anode while electroplating metal onto a substrate, the substrate being substantially planar; (b) a substrate holder configured to support the substrate such that a plating face of the substrate is immersed in the electrolyte and separated from the anode during plating; (c) an ionically resistive element adapted to provide ionic transport through the ionically resistive element during electroplating, where the ionically resistive element is a plate including a plurality of through-holes; (d) a cross flow manifold positioned above the ionically resistive element and below the plating face of the substrate, when the substrate is present in the substrate holder; and (e) a membrane in physical contact with the ionically resistive element, where the membrane is adapted to provide ionic transport through the membrane during electroplating, and where the membrane is adapted to reduce a flow of electrolyte through the ionically resistive element during electroplating.

In various embodiments, the membrane is planar and is positioned within a plane parallel to the ionically resistive element. In some cases, the membrane covers all of the plurality of through-holes in the ionically resistive element. In some other cases, the membrane includes one or more cutout regions such that the membrane only covers some of the plurality of through-holes in the ionically resistive element. In one example, the membrane includes a first cutout region positioned near a center of the ionically resistive element. In these or other embodiments, the membrane may include a second cutout region positioned near a side inlet to the cross flow manifold. In certain implementations, the cutout region is azimuthally non-uniform. In one example, the cutout region extends between the side inlet and a center of the ionically resistive element.

In some embodiments, the membrane is positioned below the ionically resistive element. In other embodiments, the membrane is positioned above the ionically resistive element. In a particular embodiment, the membrane is positioned below the ionically resistive element and a second membrane is positioned above the ionically resistive element, in contact with the ionically resistive element.

In certain implementations, the apparatus further includes a membrane frame configured to position the membrane in physical contact with the ionically resistive element. In a particular example, the membrane is positioned above the ionically resistive element, the membrane frame is positioned above the membrane, and the membrane frame includes a first set of ribs that are linear and parallel to one another, and extend in a direction perpendicular to a direction of cross flowing electrolyte within the cross flow manifold. In some such cases, the membrane frame further includes a second set of ribs that extend in a direction perpendicular to the first set of ribs. The membrane frame is a plate having a plurality of openings therein. The openings may be circular. The openings may also be another shape (e.g., ovular, polygonal, etc.). In some examples, the membrane frame is ring-shaped. The ring-shaped membrane frame may support the membrane at its periphery (or a portion thereof).

In another aspect of the disclosed embodiments, an electroplating apparatus is provided, the apparatus including: (a) a plating chamber configured to contain an electrolyte and an anode while electroplating metal onto a substrate, the substrate being substantially planar; (b) a substrate holder configured to support the substrate such that a plating face of the substrate is immersed in the electrolyte and separated from the anode during plating; (c) an ionically resistive element adapted to provide ionic transport through the ionically resistive element during electroplating, where the ionically resistive element is a plate including a plurality of through-holes; (d) a cross flow manifold positioned above the ionically resistive element and below the plating face of the substrate, when the substrate is present in the substrate holder; (e) a side inlet for introducing electrolyte to the cross flow manifold; (f) a side outlet for receiving electrolyte flowing in the cross flow manifold, where the side inlet and side outlet are positioned proximate azimuthally opposing perimeter locations on the plating face of the substrate during electroplating, and where the side inlet and side outlet are adapted to generate cross-flowing electrolyte in the cross flow manifold during electroplating; (g) an anode chamber membrane frame positioned below the ionically resistive element; and (h) an ionically resistive element manifold positioned below the ionically resistive element and above the anode chamber membrane frame, where the ionically resistive element manifold includes a plurality of baffle regions that are partially separated from one another by vertically oriented baffles positioned below the ionically resistive element, where each baffle extends from a first region proximate the ionically resistive element to a second region proximate the anode chamber membrane frame, where the baffles do not physically contact the anode chamber membrane frame, and where during electroplating electrolyte travels (i) from the plurality of electrolyte source regions, through the ionically resistive element, into the cross flow manifold, and out the side outlet, (ii) from the side inlet, through the cross flow manifold, and out the side outlet, and (iii) under the baffles from one baffle region to another.

In another aspect of the disclosed embodiments, an electroplating apparatus is provided, the apparatus including: (a) a plating chamber configured to contain an electrolyte and an anode while electroplating metal onto a substrate, the substrate being substantially planar; (b) a substrate holder configured to support the substrate such that a plating face of the substrate is immersed in the electrolyte and separated from the anode during plating; (c) an ionically resistive element adapted to provide ionic transport through the ionically resistive element during electroplating, where the ionically resistive element is a plate including a plurality of through-holes; (d) a cross flow manifold positioned above the ionically resistive element and below the plating face of the substrate, when the substrate is present in the substrate holder; (e) an anode chamber membrane frame positioned below the ionically resistive element, the anode chamber membrane frame configured to mate with an anode chamber membrane; and (f) an ionically resistive element manifold positioned below the ionically resistive element and above the anode chamber membrane, when present, where the ionically resistive element manifold includes a plurality of baffle regions that are at least partially separated from one another by vertically oriented baffles, where each baffle extends from a first region proximate the ionically resistive element to a second region proximate the anode chamber membrane.

In some embodiments, the baffles extend linearly across the ionically resistive element manifold in a direction perpendicular to a direction between a side inlet and a side outlet, where the side inlet and side outlet are adapted to generate cross-flowing electrolyte in the cross flow manifold during electroplating. In some cases, the apparatus further includes the anode chamber membrane in contact with the anode chamber membrane frame, where the anode chamber membrane separates the anode from the substrate during electroplating. In various embodiments, an upper region of each baffle may be in physical contact with the ionically resistive element or a frame positioned proximate the ionically resistive element. In these or other embodiments, during electroplating, the baffles may operate to reduce an amount of electrolyte that travels from the cross flow manifold, through the ionically resistive element, and into the ionically resistive element manifold. The anode chamber membrane frame may include the baffles in some cases. In certain implementations, the apparatus further includes a back side insert positioned between the ionically resistive element and the anode chamber membrane frame, where the back side insert includes a plurality of protrusions oriented parallel to the baffles and configured to mate with the baffles. In some cases, the baffles do not extend all the way to the anode chamber membrane frame. In some instances, the ionically resistive element includes the baffles. In these or other cases, the apparatus may further include a back side insert positioned between the ionically resistive element and the anode chamber membrane frame, and the back side insert may include the baffles. In certain other cases, the baffles are removable pieces that are not integral with the ionically resistive element, the anode chamber membrane frame, nor the back side insert. In some such cases, the baffles fit into recesses in at least one of the ionically resistive element, the anode chamber membrane frame, and the back side insert.

In a further aspect of the disclosed embodiments, a method of electroplating is provided, the method including electroplating a substrate in any of the electroplating apparatus described herein.

These and other features will be described below with reference to the associated drawings.

BRIEF DESCRIPTION OF THE DRAWINGS

FIG. 5A illustrates an electroplating apparatus that includes a series of baffles in an ionically resistive element manifold.

FIG. 5B depicts a back side insert that includes a series of baffles according to certain implementations.

FIG. 5C depicts the back side insert of FIG. 5B installed under an ionically resistive element and above a membrane frame that defines an anode chamber.

DETAILED DESCRIPTION

Described herein are apparatus and methods for electroplating one or more metals onto a substrate. Embodiments are described generally where the substrate is a semiconductor wafer; however the embodiments are not so limited.

Figure 1A:
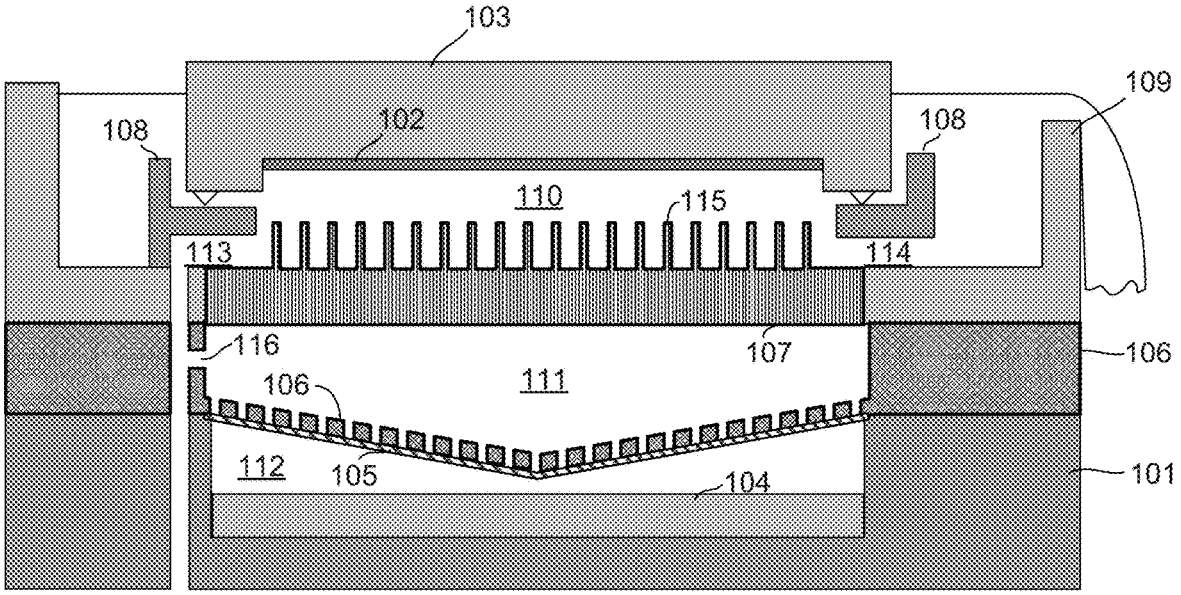
FIG. 1A illustrates an electroplating apparatus that utilizes a combination of cross flow and impinging flow on the substrate surface during electroplating.
Figure 1B:
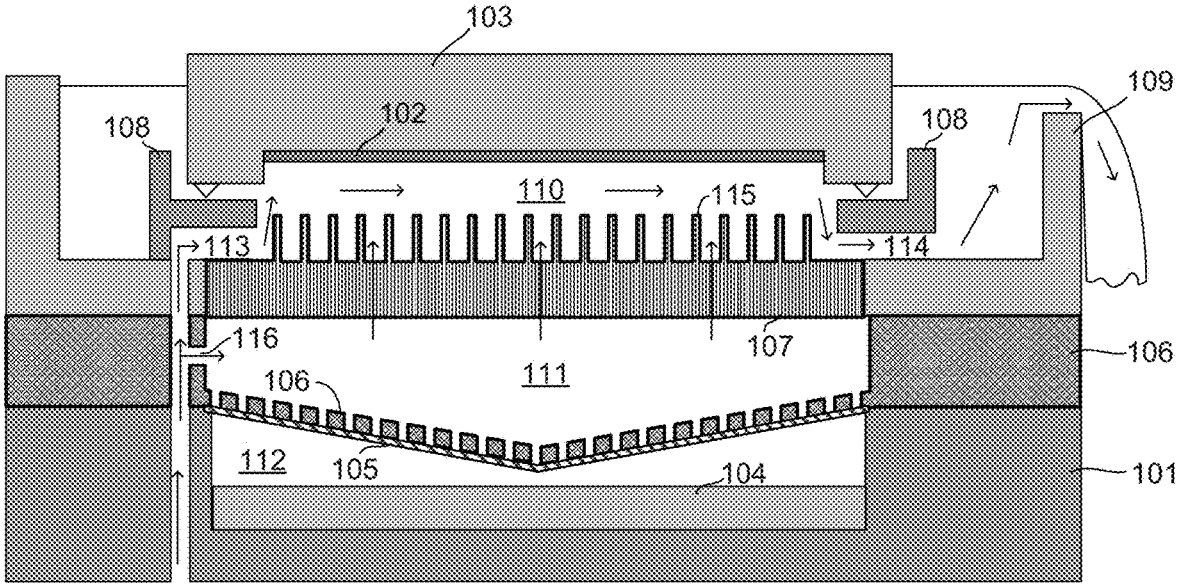
FIG. 1B shows the flow of electrolyte through the electroplating apparatus shown in FIG. 1A.

FIGS. 1A and 1B depict simplified cross-sectional views of an electroplating apparatus. FIG. 1B includes arrows showing the flow of electrolyte during electroplating in various embodiments. FIG. 1A depicts an electroplating cell 101, with substrate 102 positioned in a substrate holder 103. Substrate holder 103 is often referred to as a cup, and it may support the substrate 102 at its periphery. An anode 104 is positioned near the bottom of the electroplating cell 101. The anode 104 is separated from the substrate 102 by a membrane 105, which is supported by a membrane frame 106. Membrane frame 106 is sometimes referred to as an anode chamber membrane frame. Further, the anode 104 is separated from the substrate 102 by an ionically resistive element 107. The ionically resistive element 107 includes openings that allow electrolyte to travel through the ionically resistive element 107 to impinge upon the substrate 102. A front side insert 108 is positioned above the ionically resistive element 107, proximate the periphery of the substrate 102. The front side insert 108 may be ring-shaped, and may be azimuthally non-uniform, as shown. The front side insert 108 is sometimes also referred to as a cross flow confinement ring. An anode chamber 112 is below the membrane 105, and is where the anode 104 is located. An ionically resistive element manifold 111 is above the membrane 105 and below the ionically resistive element 107. A cross flow manifold 110 is above the ionically resistive element 107 and below the substrate 102. The height of the cross flow manifold is considered to be the distance between the substrate 102 and the plane of the ionically resistive element 107 (excluding the ribs on the upper surface of the ionically resistive element 107, if present). In some cases, the cross flow manifold may have a height between about 1 mm-4 mm, or between about 0.5 mm-15 mm. The cross flow manifold 110 is defined on its sides by the front side insert 108, which acts to contain the cross flowing electrolyte within the cross flow manifold 110. A side inlet 113 to the cross flow manifold 110 is provided azimuthally opposite a side outlet 114 to the cross flow manifold 110. The side inlet 113 and side outlet 114 may be formed, at least partially, by the front side insert 108. As shown by the arrows in FIG. 1B, electrolyte travels through the side inlet 113, into the cross flow manifold 110, and out the side outlet 114. In addition, electrolyte may travel through one or more inlets 116 to the ionically resistive element manifold 111, into the ionically resistive element manifold 111, through the openings in the ionically resistive element 107, into the cross flow manifold 110, and out the side outlet 114. Although inlet 116 is shown as fluidically connected with a conduit that feeds both the ionically resistive element manifold 111 and the side inlet 113/cross flow manifold 110, it is understood that in some cases the flows to these regions may be separate and independently controllable. After passing through the side outlet 114, the electrolyte spills over weir wall 109. The electrolyte may be recovered and recycled.

In certain embodiments, the ionically resistive element 107 approximates a nearly constant and uniform current source in the proximity of the substrate (cathode) and, as such, may be referred to as a high resistance virtual anode (HRVA) or channeled ionically resistive element (CIRP) in some contexts. Normally, the ionically resistive element 107 is placed in close proximity with respect to the wafer. In contrast, an anode in the same close-proximity to the substrate would be significantly less apt to supply a nearly constant current to the wafer, but would merely support a constant potential plane at the anode metal surface, thereby allowing the current to be greatest where the net resistance from the anode plane to the terminus (e.g., to peripheral contact points on the wafer) is smaller. So while the ionically resistive element 107 has been referred to as a high-resistance virtual anode (HRVA), this does not imply that electrochemically the two are interchangeable. Under certain operational conditions, the ionically resistive element 107 would more closely approximate and perhaps be better described as a virtual uniform current source, with nearly constant current being sourced from across the upper plane of the ionically resistive element 107.

The ionically resistive element 107 contains micro size (typically less than 0.04") through-holes that are spatially and ionically isolated from each other. In some cases, the through-holes do not form interconnecting channels within the body of ionically resistive element. Such through-holes are often referred to as non-communicating or one dimensional through-holes. They typically extend in one dimension, often, but not necessarily, normal to the plated surface of the wafer (in some embodiments the non-communicating holes are at an angle with respect to the wafer which is generally parallel to the ionically resistive element front surface). Often the non-communicating through-holes are parallel to one another. Often the non-communicating through-holes are arranged in a square array. Other times the layout is in an offset spiral pattern. These non-communicating through-holes are distinct from 3-D porous networks, where the channels extend in three dimensions and form interconnecting pore structures, because the non-communicating through-holes restructure both ionic current flow and (in certain cases) fluid flow parallel to the surface therein, and straighten the path of both current and fluid flow towards the wafer surface. However, in certain embodiments, such a porous plate, having an interconnected network of pores, may be used as the ionically resistive element. As used herein, the term "through-holes" is intended to cover both non-communicating through-holes and interconnected networks of pores, unless otherwise specified. When the distance from the plate's top surface to the wafer is small (e.g., a gap of about 1/10 the size of the wafer radius, for example less than about 5 mm), divergence of both current flow and fluid flow is locally restricted, imparted and aligned with the ionically resistive element channels.

One example ionically resistive element 107 is a disc made of a solid, non-porous dielectric material that is ionically and electrically resistive. The material is also chemically stable in the plating solution of use. In certain cases the ionically resistive element 107 is made of a ceramic material (e.g., aluminum oxide, stannic oxide, titanium oxide, or mixtures of metal oxides) or a plastic material (e.g., polyethylene, polypropylene, polyvinylidene difluoride (PVDF), polytetrafluoroethylene, polysulphone, polyvinyl chloride (PVC), polycarbonate, and the like), having between about 6,000-12,000 non-communicating through-holes. The ionically resistive element 107, in many embodiments, is substantially coextensive with the wafer (e.g., the ionically resistive element 107 has a diameter of about 300 mm when used with a 300 mm wafer) and resides in close proximity to the wafer, e.g., just below the wafer in a wafer-facing-down electroplating apparatus. Preferably, the plated surface of the wafer resides within about 10 mm, more preferably within about 5 mm of the closest ionically resistive element surface. To this end, the top surface of the ionically resistive element 107 may be flat or substantially flat. Often, both the top and bottom surfaces of the ionically resistive element 107 are flat or substantially flat. In a number of embodiments, however, the top surface of the ionically resistive element 107 includes a series of linear ribs, as described further below.

As above, the overall ionic and flow resistance of the plate 107 is dependent on the thickness of the plate and both the overall porosity (fraction of area available for flow through the plate) and the size/diameter of the holes. Plates of lower porosities will have higher impinging flow velocities and ionic resistances. Comparing plates of the same porosity, one having smaller diameter 1-D holes (and therefore a larger number of 1-D holes) will have a more micro-uniform distribution of current on the wafer because there are more individual current sources, which act more as point sources that can spread over the same gap, and will also have a higher total pressure drop (high viscous flow resistance). The flow of electrolyte through the ionically resistive element 107 can also be affected by the presence of a membrane provided parallel to and in physical contact with the ionically resistive element 107, as discussed further below.

In some cases, about 1-10% of the ionically resistive element 107 is open area through which ionic current can pass (and through which electrolyte can pass if there is no other element blocking the openings). In particular embodiments, about 2-5% the ionically resistive element 107 is open area. In a specific example, the open area of the ionically resistive element 107 is about 3.2% and the effective total open cross sectional area is about 23 $cm^2$. In some embodiments, non-communicating holes formed in the ionically resistive element 107 have a diameter of about 0.01 to 0.08 inches. In some cases, the holes have a diameter of about 0.02 to 0.03 inches, or between about 0.03-0.06 inches. In various embodiments the holes have a diameter that is at most about 0.2 times the gap distance between the ionically resistive element 107 and the wafer. The holes are generally circular in cross section, but need not be. Further, to ease construction, all holes in the ionically resistive element 107 may have the same diameter. However this need not be the case, and both the individual size and local density of holes may vary over the ionically resistive element surface as specific requirements may dictate.

The ionically resistive element 107 shown in FIGS. 1A and 1B includes a series of linear ribs 115 that extend into/out of the page. The ribs 115 are sometimes referred to as protuberances. The ribs 115 are positioned on the top surface of the ionically resistive element 107, and they are oriented such that their length (e.g., their longest dimension) is perpendicular to the direction of cross flowing electrolyte. The ribs 115 affect the fluid flow and current distribution within the cross flow manifold 110. For instance, the cross flow of electrolyte is largely confined to the area above the top surface of the ribs 115, creating a high rate of electrolyte cross flow. In the regions between adjacent ribs 115, current delivered upward through the ionically resistive element 107 is redistributed, becoming more uniform, before it is delivered to the substrate surface.

In FIGS. 1A and 1B, the direction of cross flowing electrolyte is left-to-right (e.g., from the side inlet 113 to the side outlet 114), and the ribs 115 are oriented such that their lengths extend into/out of the page. In certain embodiments, the ribs 115 may have a width (measured left-to-right in FIG. 1A) between about 0.5 mm-1.5 mm, in some cases between about 0.25 mm-10 mm. The ribs 115 may have a height (measured up-down in FIG. 1A) between about 1.5 mm-3.0 mm, in some cases between about 0.25 mm-7.0 mm. The ribs 115 may have a height to width aspect ratio (height/width) between about 5/1-2/1, in some cases between about 7/1-1/7. The ribs 115 may have a pitch between about 10 mm-30 mm, in some cases between about 5 mm-150 mm. The ribs 115 may have variable lengths (measured into/out of the page in FIG. 1A) that extend across the face of the ionically resistive element 107. The distance between the upper surface of the ribs 115 and the surface of the substrate 102 may be between about 1 mm-4 mm, or between about 0.5 mm-15 mm. The ribs 115 may be provided over an area that is about coextensive with the substrate, as shown in FIGS. 1A and 1B. The channels/openings in the ionically resistive element 107 may be positioned between adjacent ribs 115, or they may extend through the ribs 115 (in other words, the ribs 115 may or may not be channeled). In some other embodiments, the ionically resistive element 107 may have an upper surface that is flat (e.g., does not include the ribs 115). The electroplating apparatus shown in FIGS. 1A and 1B, including the ionically resistive element with ribs thereon, is further discussed in U.S. Pat. No. 9,523,155, titled "ENHANCEMENT OF ELECTROLYTE HYDRODYNAMICS FOR EFFICIENT MASS TRANSFER DURING ELECTROPLATING," which is herein incorporated by reference in its entirety.

The apparatus may include various additional elements as needed for a particular application. In some cases, an edge flow element may be provided proximate the periphery of the substrate, within the cross flow manifold. The edge flow element may be shaped and positioned to promote a high degree of electrolyte flow (e.g., cross flow) near the edges of the substrate. The edge flow element may be ring-shaped or arc-shaped in certain embodiments, and may be azimuthally uniform or non-uniform. Edge flow elements are further discussed in U.S. patent application Ser. No. 14/924,124, filed Oct. 27, 2015, and titled "EDGE FLOW ELEMENT FOR ELECTROPLATING APPARATUS," which is herein incorporated by reference in its entirety.

In some cases, the apparatus may include a sealing member for temporarily sealing the cross flow manifold. The sealing member may be ring-shaped or arc-shaped, and may be positioned proximate the edges of the cross flow manifold. A ring-shaped sealing member may seal the entire cross flow manifold, while an arc-shaped sealing member may seal a portion of the cross flow manifold (in some cases leaving the side outlet open). During electroplating, the sealing member may be repeatedly engaged and disengaged to seal and unseal the cross flow manifold. The sealing member may be engaged and disengaged by moving the substrate holder, ionically resistive element, front side insert, or other portion of the apparatus that engages with the sealing member. Sealing members and methods of modulating cross flow are further discussed in the following U.S. patent applications, each of which is herein incorporated by reference in its entirety: U.S. patent application Ser. No. 15/225,716, filed Aug. 1, 2016, and titled "DYNAMIC MODULATION OF CROSS FLOW MANIFOLD DURING ELECTROPLATING"; and U.S. patent application Ser. No. 15/161,081, filed May 20, 2016, and titled "DYNAMIC MODULATION OF CROSS FLOW MANIFOLD DURING ELECTROPLATING."

In various embodiments, one or more electrolyte jet may be provided to deliver additional electrolyte above the ionically resistive element. The electrolyte jet may deliver electrolyte proximate a periphery of the substrate, or at a location that is closer to the center of the substrate, or both. The electrolyte jet may be oriented in any position, and may deliver cross flowing electrolyte, impinging electrolyte, or a combination thereof. Electrolyte jets are further described in U.S. patent application Ser. No. 15/455,011, filed Mar. 9, 2017, and titled "ELECTROPLATING APPARATUS AND METHODS UTILIZING INDEPENDENT CONTROL OF IMPINGING ELECTROLYTE," which is herein incorporated by reference in its entirety.

Figure 1C:
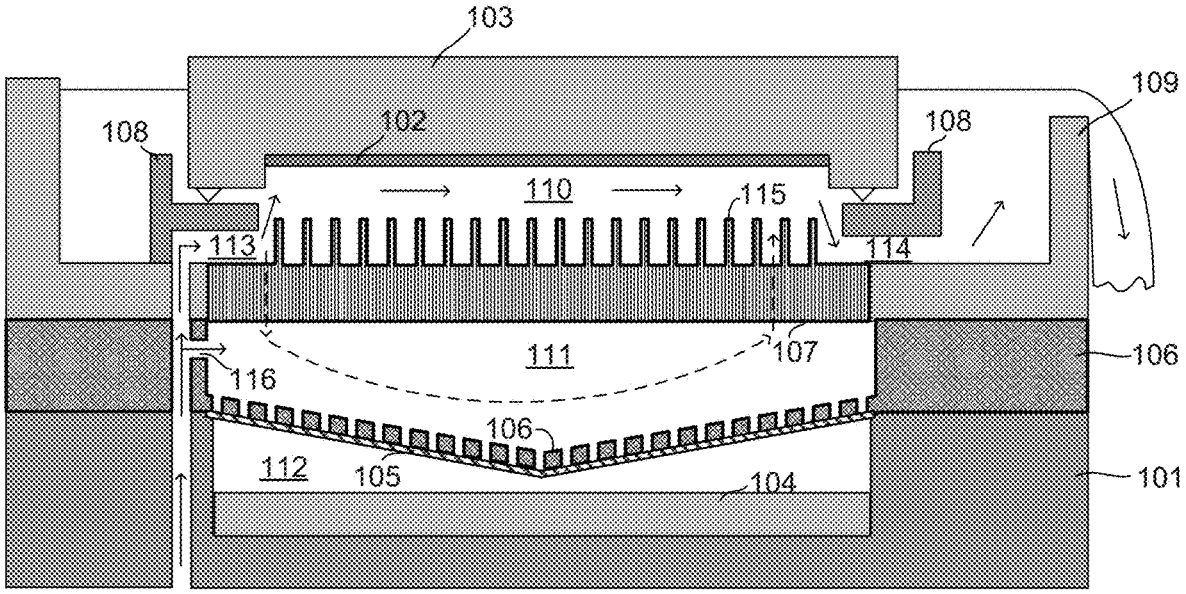
FIG. 1C depicts a flow bypass problem that can arise in some cases when electroplating using the apparatus shown in FIGS. 1A and 1B.

FIG. 1C illustrates a problem that can arise when electroplating using the apparatus shown in FIGS. 1A and 1B. In certain implementations, there is a pressure differential between the cross flow manifold 110 (which is at higher pressure due to a significant amount of electrolyte flow through the side inlet 113) and the ionically resistive element manifold 111 (which is at lower pressure). In some cases, the pressure differential may be at least about 3000 Pa, or at least about 1200 Pa. These regions are separated by the ionically resistive element 107. Because of the pressure differential, some electrolyte which is delivered through the side inlet 113 travels downward/backward through the openings in the ionically resistive element 107, into the ionically resistive element manifold 111. The electrolyte travels back up through the ionically resistive element 107 when it is near the side outlet 114. In other words, electrolyte which is intended to shear over the substrate in the cross flow manifold bypasses the cross flow manifold by instead flowing through the ionically resistive element manifold. This unwanted electrolyte flow is shown in dotted arrow lines in FIG. 1C. The flow of electrolyte downward through the ionically resistive element 107 is undesirable because the electrolyte delivered through the side inlet 113 is intended to shear over a plating face of the substrate 102 within the cross flow manifold 110. Any electrolyte which travels down through the ionically resistive element 107 is no longer shearing over the plating face of the substrate 102, as desired. The result is an overall lower-than-desired convection at the plating face of the substrate, as well as non-uniform convection over different portions of the substrate. These issues can cause substantial plating non-uniformities in some cases.

Various embodiments herein relate to methods and apparatus for reducing and/or controlling the degree to which electrolyte delivered to the cross flow manifold is able to bypass the cross flow manifold as described in relation to FIG. 1C. In some implementations, a membrane is provided proximate the ionically resistive element. The membrane reduces the degree to which electrolyte is able to flow through the ionically resistive element. In some cases, the membrane may be uniform, and may cover all or substantially all of the openings in the ionically resistive element. In some other cases, the membrane may include one or more cutouts designed to route electrolyte in a desired manner. In some other implementations, one or more baffles may be provided in the ionically resistive element manifold, where the baffles operate to reduce the degree to which electrolyte can travel across the electroplating cell (e.g., in a direction of cross flowing electrolyte) within the ionically resistive element manifold. Each of these embodiments will be discussed in turn.

Membrane Proximate Ionically Resistive Element

In many cases, one or more membrane may be provided proximate an ionically resistive element. The membrane may be provided in a plane parallel to the ionically resistive element, in physical contact with this element. The membrane may be provided to reduce the degree to which electrolyte is able to flow backwards from the cross flow manifold, through the ionically resistive element, and down into the ionically resistive element manifold. The membrane may similarly reduce the degree to which electrolyte is able to flow in the opposite direction, from the ionically resistive element manifold, through the ionically resistive element, and up into the cross flow manifold. Such a membrane may be provided in addition to a membrane that separates the anode from the substrate (e.g., membrane 105 in FIGS. 1A-1C), and may be provided for a different purpose. For instance, with reference to FIG. 1A, the function of membrane 105 is to separate and provide cationic exchange between (a) the anode 104/anode chamber 112 and (b) the substrate 102/ionically resistive element manifold 111. By contrast, a membrane provided proximate an ionically resistive element 107 is provided primarily to prevent electrolyte from short-circuiting as described herein.

Although such a membrane may reduce the degree to which electrolyte impinges upon the surface of the substrate (e.g., after jetting through the holes in the ionically resistive element), this effect may be outweighed by benefits related to higher cross flow within the cross flow manifold (especially near the center of the substrate), improved non-uniformity of plating results, and in some cases, purposeful routing of electrolyte to particular portions of the substrate surface.

Position of Membrane

Figure 2A:
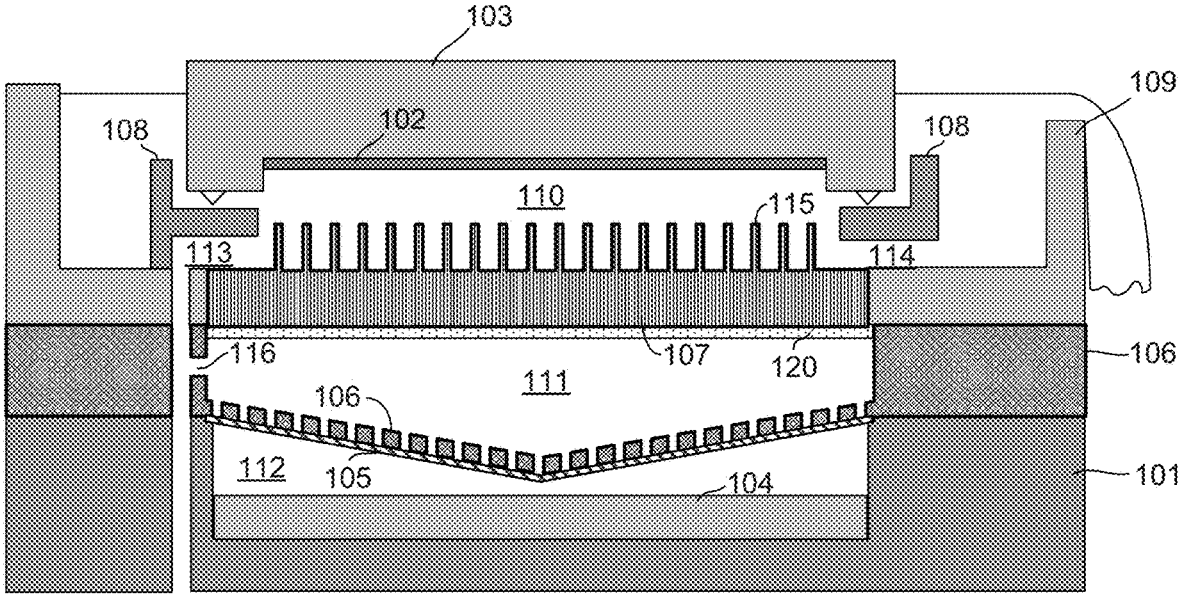
FIG. 2A illustrates an electroplating apparatus that includes a membrane directly below an ionically resistive element.
Figure 2B:
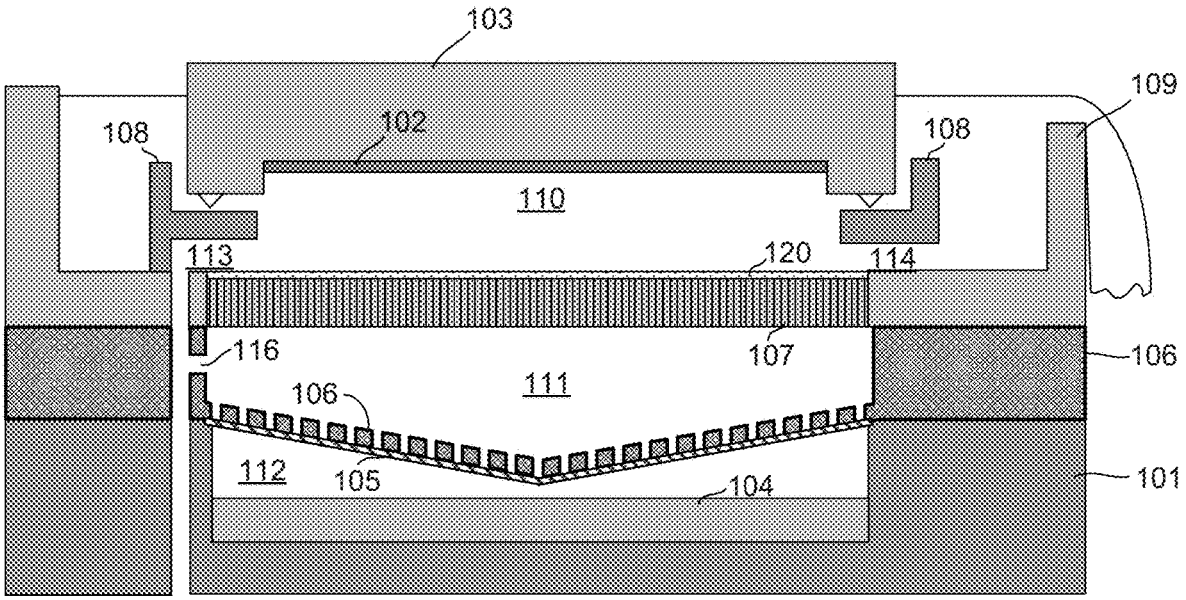
FIG. 2B illustrates an electroplating apparatus that includes a membrane directly above an ionically resistive element.
Figure 2C:
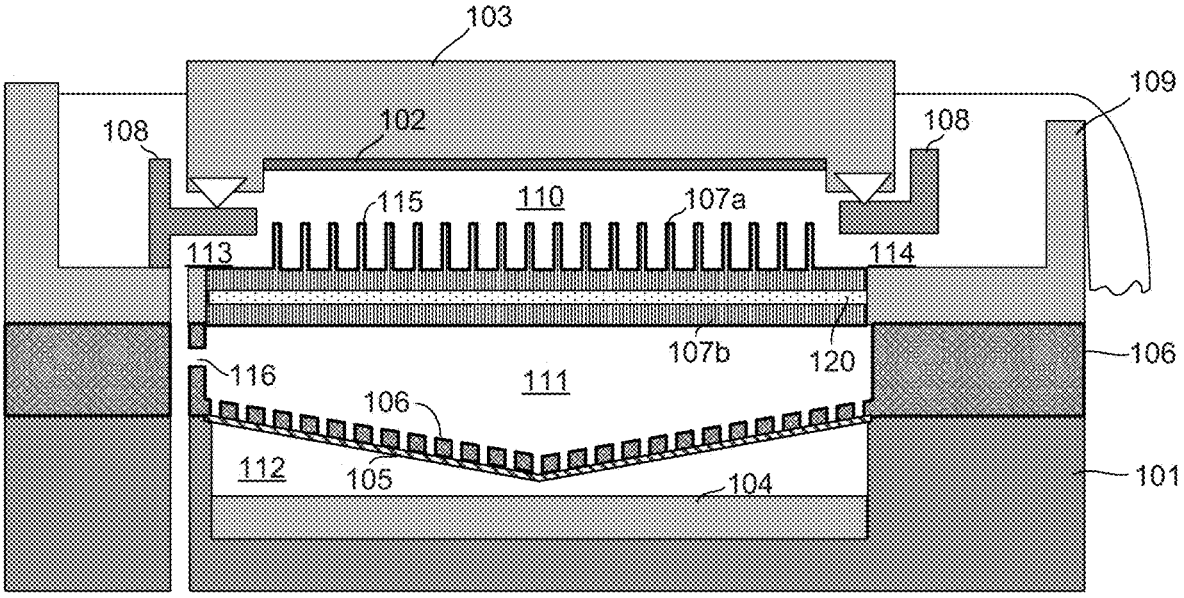
FIG. 2C illustrates an electroplating apparatus that includes a membrane sandwiched between two portions of an ionically resistive element.

The membrane may be positioned either above the ionically resistive element, below the ionically resistive element, or within the ionically resistive element. FIG. 2A depicts an example in which a membrane 120 is provided below the ionically resistive element 107, FIG. 2B depicts an example in which membrane 120 is provided above the ionically resistive element 107, and FIG. 2C depicts an example in which membrane 120 is provided within the ionically resistive element 107*a*/107*b*. In the embodiment of FIG. 2A, the ionically resistive element 107 includes a series of linear ribs 115 on its upper surface, and the membrane 120 is positioned in contact with the bottom surface of the ionically resistive element 107. In the embodiment of FIG. 2B, the linear ribs 115 are omitted and the ionically resistive element 107 includes a flat upper surface that mates with the membrane 120. In the embodiment of FIG. 2C, the ionically resistive element is formed from an upper portion 107*a* and a lower portion 107*b* that sandwich membrane 120. The upper portion 107*a* includes the series of linear ribs 115, though they may be omitted in certain cases.

In each of FIGS. 2A-2C, the membrane 120 is positioned parallel to the substrate 102, which is also parallel to the ionically resistive element 107 (e.g., excluding any ribs 115). The membrane 120 is in contact with at least one surface of the ionically resistive element 107. Because of this contact, the membrane 120 blocks the openings in the ionically resistive element 107, making it more difficult for electrolyte to travel through the ionically resistive element 107. As a result, a greater proportion of the electrolyte which is delivered from the side inlet 113 to the cross flow manifold 110 will be maintained within the cross flow manifold 110, rather than bypassing the cross flow manifold 110 by flowing down through the ionically resistive element 107 and into the ionically resistive element manifold 111. In other words, the membrane 120 operates to maintain a high degree of cross flow within the cross flow manifold 110, despite the pressure differential between the cross flow manifold 110 and the ionically resistive element manifold 111.

Material and Thickness of Membrane

The membrane may be made of a variety of materials. Generally, any material used for membrane 105 may also be used for membrane 120. Membrane 105 is further described in the following U.S. patents, each of which is herein incorporated by reference in its entirety: U.S. Pat. No. 9,677,190, titled "MEMBRANE DESIGN FOR REDUCING DEFECTS IN ELECTROPLATING SYSTEMS"; U.S. Pat. No. 6,527,920, titled "COPPER ELECTROPLATING METHOD AND APPARATUS"; U.S. Pat. No. 6,821,407, titled "ANODE AND ANODE CHAMBER FOR COPPER ELECTROPLATING"; and U.S. Pat. No. 8,262,871, titled "PLATING METHOD AND APPARATUS WITH MULTIPLE INTERNALLY IRRIGATED CHAMBERS."

The membrane material allows current to pass easily through the membrane, while reducing the degree to which fluid is able to pass through the membrane. In various cases, the membrane material has a relatively high flow resistance factor. As an example, the membrane may exhibit a pure water flux between about 1-2.5 GFD/PSI at about 25° C.

Example materials for the membrane include, but are not limited to, sub-micron filter materials, nanoporous filter materials, ion exchange materials (e.g., cation exchange materials), etc. Commercial examples of these include Dupont Nafion N324, Ion Power Vanadion 20-L, and Koch Membranes HFK-328 (PE/PES). These materials provide a substantial flow resistance, while allowing ions to migrate through the membrane when under the influence of an electromotive force.

The membrane should be sufficiently thick to be mechanically stable and provide a relatively high flow resistance. The membrane should be sufficiently thin to allow ionic current to easily pass through. In some embodiments, the membrane may have a thickness (measured up-down in FIGS. 2A-2C) between about 0.1 mm-0.5 mm.

Membrane Frame

In a number of embodiments, a membrane frame may be provided to secure the membrane to the ionically resistive element. The membrane frame may be made of any of the same materials used to form anode chamber membrane frame 106, which supports membrane 105. The material used to fabricate the membrane frame should be resistant to the chemistry used during electroplating. Example materials include, but are not limited to, polyethylene, polyethylene terephthalate, polycarbonate, polypropylene, polyvinyl chloride, polyphenylene sulfide, etc. In some cases the membrane frame may be fabricated using 3D printing techniques.

The membrane frame should be shaped such that it supports the membrane against the ionically resistive element, while substantially allowing current to pass through the membrane. Many different designs are possible, further discussed below in relation to FIGS. 3C-3H.

Figure 3A:
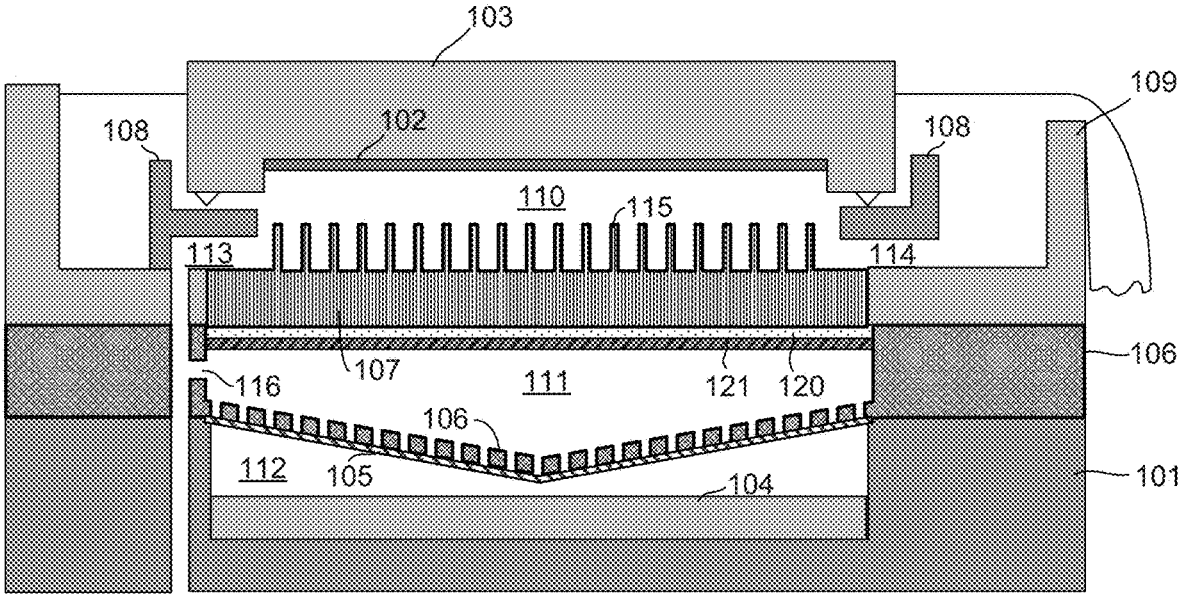
FIG. 3A shows an electroplating apparatus that includes a membrane and membrane frame directly below an ionically resistive element.
Figure 3B:
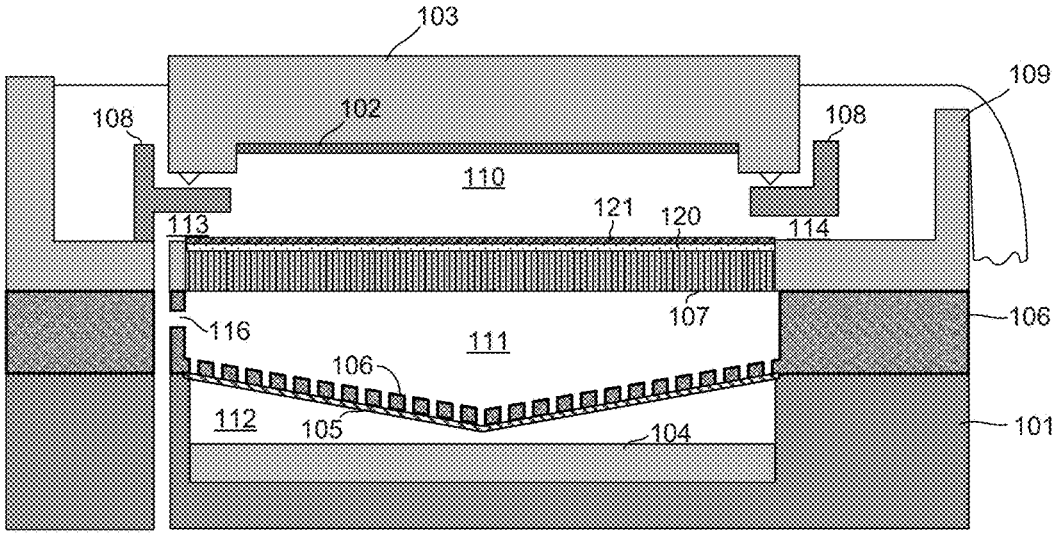
FIG. 3B illustrates an electroplating apparatus that includes a membrane and membrane frame directly above an ionically resistive element.

FIG. 3A illustrates an electroplating apparatus similar to that shown in FIG. 2A (with membrane 120 positioned below the ionically resistive element 107), with the addition of membrane frame 121 below the membrane 120. FIG. 3B depicts an electroplating apparatus similar to that shown in FIG. 2B (with membrane 120 positioned above the ionically resistive element 107), with the addition of membrane frame 121 above the membrane 120. Although FIGS. 3A and 3B depict the membrane frame as a solid piece of material, it is understood that the membrane includes openings through which ionic current is able to pass.

Figure 3C:
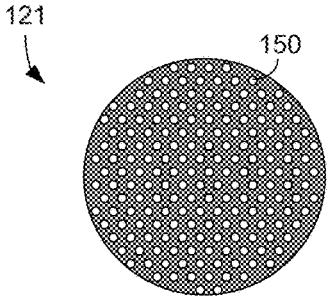
FIGS. 3C-3H depict various membrane frames according to embodiments.
Figure 3D:
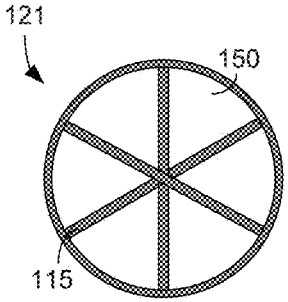
Figure 3E:
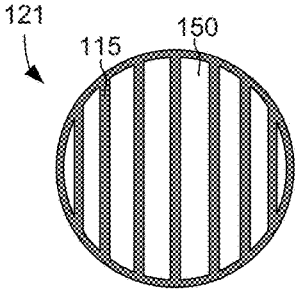
Figure 3F:
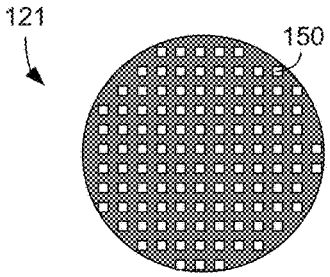
Figure 3G:
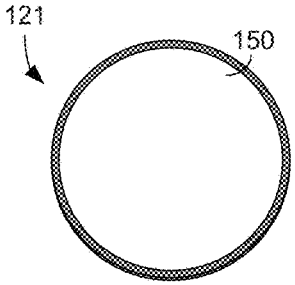
Figure 3H:
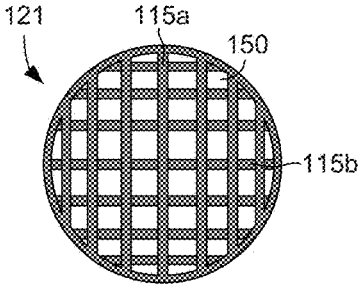

FIGS. 3C-3H depict top-down views of membrane frames 121 that may be used in various embodiments. In FIG. 3C the membrane frame 121 includes a pattern of circular openings 150 formed in a plate. Any number, size, shape, and layout of openings 150 can be used, as long as sufficient current is able to pass through the openings. In FIG. 3D the membrane frame 121 includes a peripheral ring with three linear ribs 115 that overlap one another. The ribs 115 each cross the center of the membrane frame 121, forming large roughly triangular openings 150 through which current can pass. Any number, size, shape, and layout of ribs 115/openings 150 can be used. In FIG. 3E the membrane frame 121 includes a peripheral ring with seven linear ribs 115 positioned parallel to one another. Openings 150 are formed between adjacent ribs 115. Any number, size, shape, and layout/orientation of ribs 115/openings 150 can be used. In FIG. 3F the membrane frame 121 includes a pattern of square openings 150 formed in a plate. This embodiment is similar to that shown in FIG. 3C, except for the shape of the openings 150. In FIG. 3G the membrane frame 121 is a simple ring that supports the membrane at its periphery. Any size ring may be used. In FIG. 3H the membrane frame 121 includes a first set of ribs 115*a* oriented parallel to one another, and a second set of ribs 115*b* oriented parallel to one another, where the first and second sets of ribs 115*a* and 115*b* are oriented perpendicular to one another. In various embodiments, the membrane frame 121 may have an open area between about 10-40% or between about 5-75%.

Any of the membrane frames 121 shown or described in relation to FIGS. 3C-3H may be used when implementing the embodiments herein. In one example, the apparatus of FIG. 3A includes one of the membrane frames 121 shown or described in relation to FIGS. 3C-3H. In another example, the apparatus of FIG. 3B includes one of the membrane frames 121 shown or described in relation to FIGS. 3C-3H.

Figure 3I:
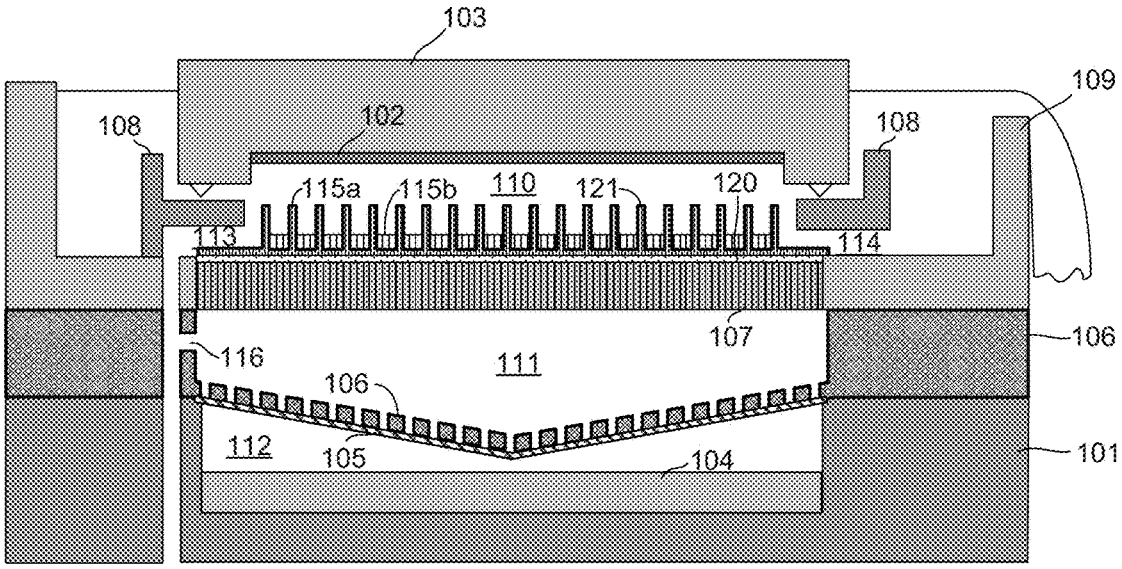
FIG. 3I depicts an electroplating apparatus having a membrane and a membrane frame positioned directly above an ionically resistive element, where the membrane frame includes a series of linear ribs on its upper surface.
Figure 3J:
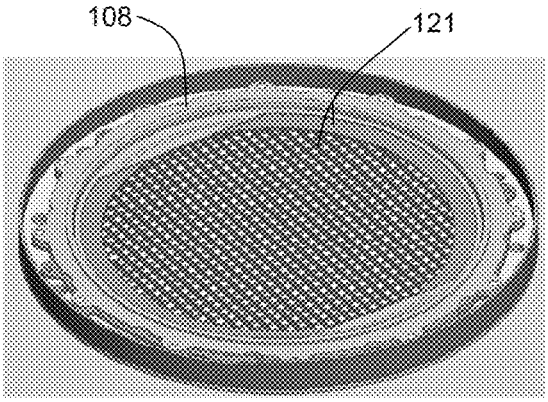
FIGS. 3J and 3K illustrate a membrane frame having two sets of perpendicularly oriented linear ribs on its upper surface.
Figure 3K:
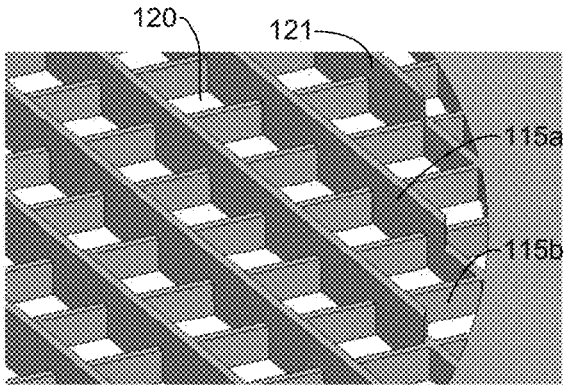

In cases where a membrane frame is provided above an ionically resistive element, the membrane frame may be designed to promote a desired flow pattern within the cross flow manifold. For example, with reference to FIG. 3A, the upper surface of the ionically resistive element 107 includes linear ribs 115 that promote a high rate of cross flow within the cross flow manifold 110. In the apparatus of FIG. 3B, these ribs 115 are omitted such that the membrane 120 lies flat against the ionically resistive element 107. The linear ribs 115 can instead be provided as part of the membrane frame 121, as shown in FIGS. 3I-3K. FIG. 3I shows a cross-sectional view of the electroplating apparatus, FIG. 3J shows a view of a cross flow confinement ring 108 positioned above membrane frame 121 (which is above membrane 120, not labeled), and FIG. 3K shows a close-up view of the membrane frame 121 over the membrane 120. The membrane frame 121 shown in FIGS. 3I-3K is similar to the one shown in FIG. 3H. In this example, the membrane frame 121 includes two sets of linear ribs including (i) a first set of linear ribs 115*a* oriented such that their length is perpendicular to the direction of cross flowing electrolyte within the cross flow manifold, and (ii) a second set of linear ribs 115*b* oriented such that their length is parallel to the direction of cross flowing electrolyte within the cross flow manifold. The first set of linear ribs 115*a* may be above, below, or flush with the second set of linear ribs 115*b* in various embodiments. In some cases, it is beneficial for the first set of ribs 115*a* (oriented perpendicular to cross flowing electrolyte) to be positioned wholly or partially above the second set of ribs 115*b* (oriented parallel to cross flowing electrolyte), as visible in FIGS. 3I and 3K. The first set of linear ribs 115*a* may promote a desired pattern of flow within the cross flow manifold 110, while the second set of ribs 115*b* may be used to provide structural rigidity to the first set of ribs 115*a*. The first and second sets of ribs 115*a* and 115*b* may have the same or different dimensions (e.g., one set of ribs may be wider, taller, etc.), and may have the same or different spacing between them (e.g., one set of ribs may be spaced farther apart).

Membrane Cutouts

In some embodiments, the membrane includes one or more cutouts designed to route electrolyte through the cross flow manifold and ionically resistive element manifold as desired. In some cases this may be done to provide more uniform electroplating results. For example, if one area of a substrate experiences less plating than desired, electrolyte may be routed to this area to promote a higher degree of plating, resulting in a more uniform plating rate overall. A lower-than-desired local plating rate may be a result of locally thick photoresist in some cases. In these or other cases, a local plating rate may be lower-than-desired due to the flow pattern of electrolyte during electroplating. For instance, in some cases features near the center of the substrate experience less convection compared to features near the edge of the substrate, resulting in curved/domed features near the center of the substrate, and flat/sharp features near the edge of the substrate. This non-uniformity (e.g., commonly referred to as within-wafer non-uniformity) is not desirable. Irrespective of the cause, the non-uniformity can be mitigated by including one or more cutouts in the membrane proximate the ionically resistive element, where the cutouts route electrolyte in a desired manner.

Figure 4A:
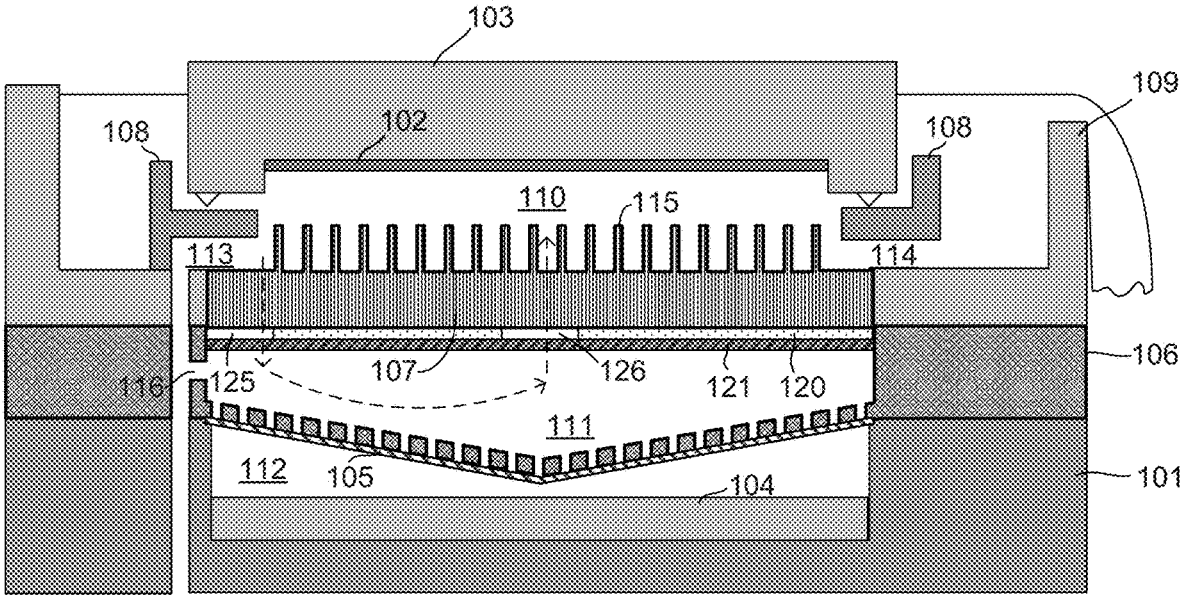
FIG. 4A shows an electroplating apparatus having a membrane and a membrane frame positioned directly below an ionically resistive element, where the membrane includes cutouts designed to route electrolyte in a desired manner.

FIG. 4A depicts an electroplating apparatus having a membrane 120 with a first cutout 125 and a second cutout 126. The first and second cutouts 125 and 126 may be implemented as shown in FIGS. 4H and 41 in some embodiments. The first cutout 125 is positioned proximate the side inlet, and the second cutout 126 is positioned near the center of the substrate. During electroplating, some electrolyte delivered through the side inlet 113 travels down through the ionically resistive element 107, through the first cutout 125 in the membrane 120, through the membrane frame 125, and into the ionically resistive element manifold 111. The electrolyte then passes upwards through the membrane frame 125, through the second cutout 126 in the membrane 120, through the ionically resistive element 107, and back into the cross flow manifold 110. The result is that electrolyte that would otherwise pass through the ionically resistive element 107 near the side outlet 114 (e.g., if membrane 120 were omitted) is instead routed back up through the ionically resistive element 107 proximate the center of the substrate, providing additional convection to the plating face of the substrate near its center. This technique is particularly advantageous in embodiments where the center of the substrate experiences relatively less convection during electroplating than the edges of the substrate. This technique is also advantageous for combating locally thick photoresist. For instance, the cutouts can be designed such that electrolyte is routed upward through the membrane 120/ionically resistive element 107 at a location proximate a region on the substrate where the photoresist is locally thick (e.g., thicker than at other locations on the substrate). The increased local convection combats plating non-uniformities that would otherwise result from non-uniform photoresist deposition.

FIGS. 4B-4J illustrate top-down views of membranes that may be used in various embodiments, where each membrane includes one or more cutout. The cutouts are shaped and positioned to route electrolyte as desired from the cross flow manifold to the ionically resistive element manifold, and vice versa. The membrane is shown with a dotted background, and the cutouts are shown in white. In FIGS. 4B-4J, the portion of the membrane proximate the side inlet is labeled "i" and the portion of the membrane proximate the side outlet is labeled "o." In cases where a single cutout is used, one region of the cutout (e.g., near the side inlet) may be used to route electrolyte downwards from the cross flow manifold to the ionically resistive element manifold, while a second region of the cutout (e.g., farther from the side inlet) may be used to route electrolyte upwards from the ionically resistive element manifold to the cross flow manifold. In cases where multiple cutouts are used, one or more cutout (e.g., near the side inlet) may be used to route electrolyte downwards from the cross flow manifold to the ionically resistive element manifold, and one or more other cutout (e.g., farther from the side inlet, in some cases near the center of the membrane or near the side outlet) may be used to route electrolyte upwards from the ionically resistive element manifold to the cross flow manifold. The flows down and up through the membrane may result naturally due to the electrolyte flow and pressure differential.

Figure 4B:
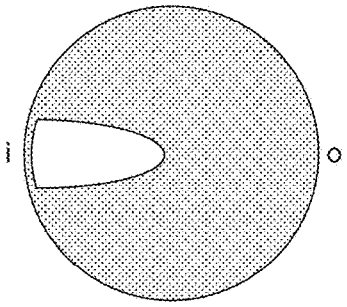
FIGS. 4B-4J illustrate a number of membranes having cutouts according to various embodiments.
Figure 4C:
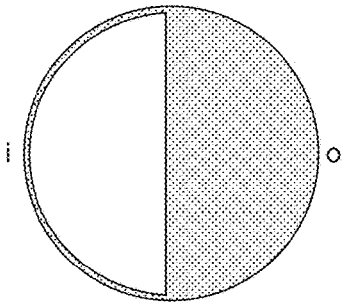
Figure 4D:
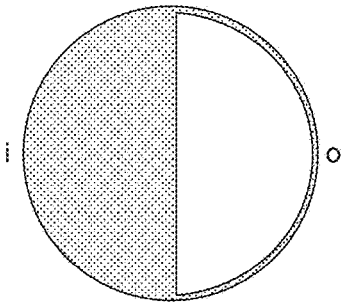
Figure 4E:
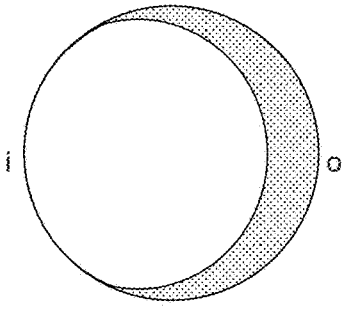
Figure 4F:
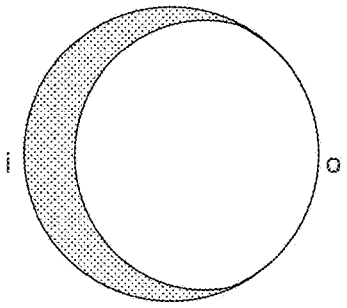
Figure 4G:
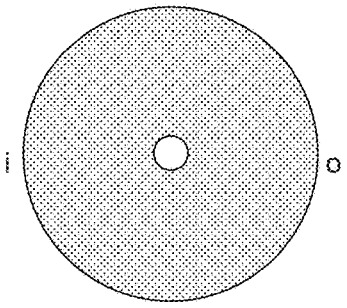
Figure 4H:
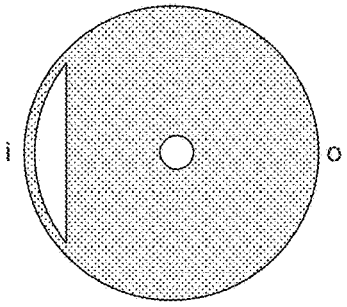
Figure 4I:
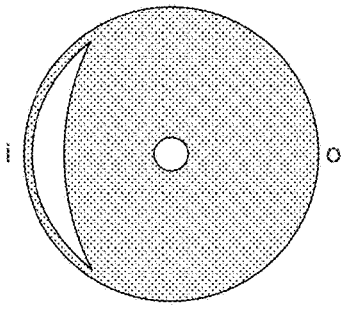
Figure 4J:
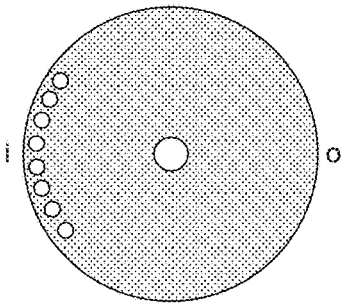

In FIG. 4B, the membrane includes a single cutout that extends from an area near the side inlet to an area at or near the center of the substrate/membrane. In FIG. 4C, the membrane includes a semi-circular cutout proximate/aligned with the side inlet, and in FIG. 4D the membrane includes a semi-circular cutout proximate/aligned with the side outlet. In FIGS. 4E and 4F, the membrane is crescent-shaped, and is either proximate/aligned with the side outlet (FIG. 4E), or is proximate/aligned with the side inlet (FIG. 4F). In FIG. 4G, the membrane includes a single circular cutout proximate the center of the substrate/membrane. In FIGS. 4H and 41, the membrane includes a first cutout proximate the side inlet and a second cutout proximate the center of the substrate/membrane. In FIG. 4J, the membrane includes a number of circular cutouts near the side inlet, and a single circular cutout near the center of the substrate/membrane. Various membrane cutout designs may be used to route electrolyte to desired portions of the substrate surface, as desired.

Figure 4K:
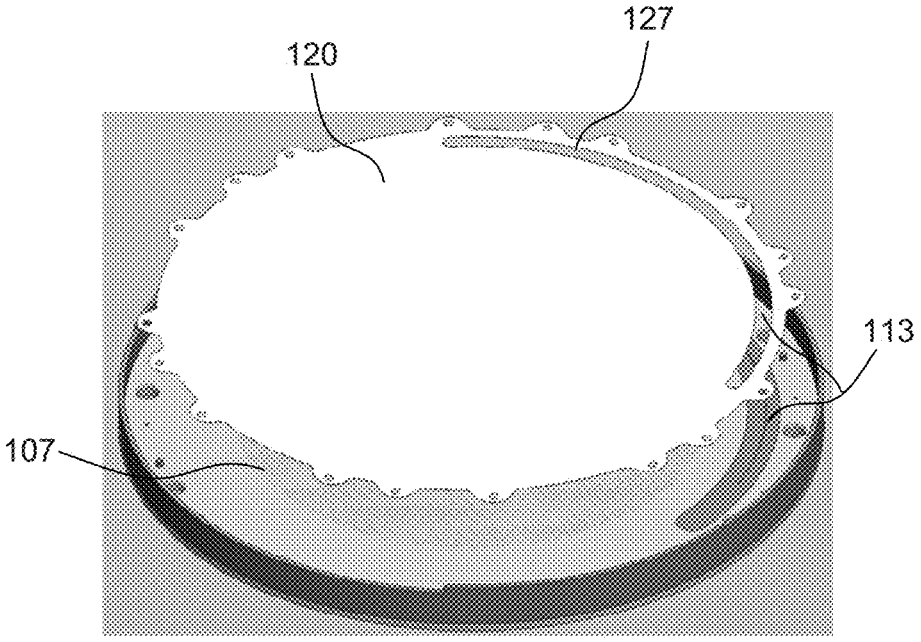
FIG. 4K shows a membrane over an ionically resistive element, where the membrane includes an inlet cutout through which electrolyte can flow as it is delivered to the side inlet.
Figure 4L:
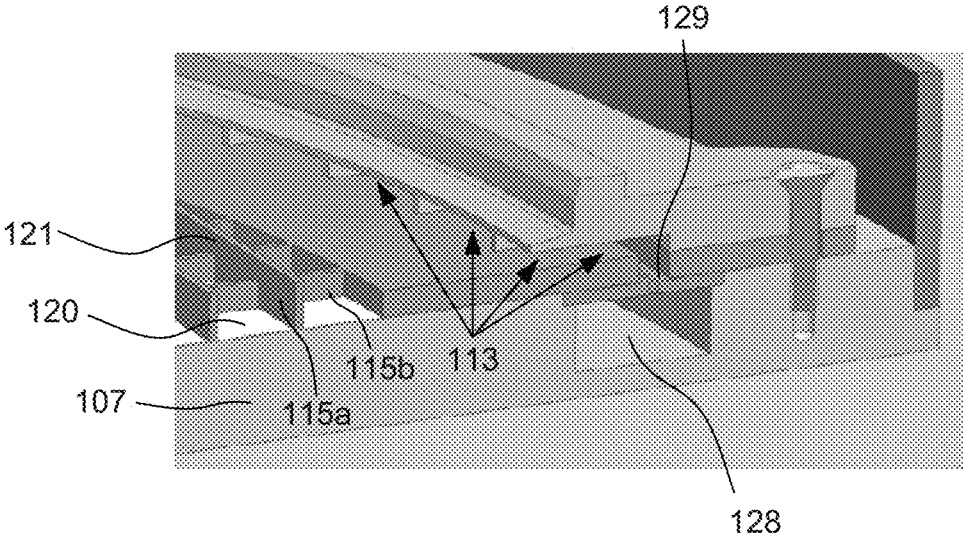
FIG. 4L depicts a close-up view of an inlet manifold formed in an ionically resistive element.

In addition to cutouts provided to route electrolyte between the cross flow manifold and the ionically resistive element manifold (e.g., as described in relation to FIGS. 4A-4J), any of the membranes, membrane frames, and ionically resistive elements described herein may include an inlet opening aligned with the side inlet to ensure that these components do not block electrolyte from passing into/through the side inlet. FIGS. 4K and 4L illustrate different views of a membrane 120 having an inlet cutout 127. The inlet cutout 127 is shaped and positioned to align with the side inlet 113. In this embodiment, the ionically resistive element 107, the membrane frame 121, and the membrane 120 each include an opening/passage through which electrolyte can flow as it is delivered to the side inlet 113. Similar openings/passages are shown in the other figures, e.g., as the vertical shaft/opening through which electrolyte flows as it travels toward the side inlet 113 (see FIG. 1B, for example). Returning to FIG. 4L, a side inlet manifold 128 is formed primarily as a cavity in the ionically resistive element 107. The top surface of the side inlet manifold 128 includes a showerhead 129 having a number of holes through which electrolyte flows. The membrane frame 121 sits atop the membrane 120 and atop the showerhead 129. The showerhead 129 is positioned at the inlet cutout 127 in the membrane 120.

Experimental results discussed below show that membranes as described herein are very useful in improving electroplating results, for example producing more desirable electrolyte flow and higher quality, more uniform plating results.

Baffles

In some embodiments, one or more baffles may be provided in the ionically resistive element manifold in order to reduce the degree to which electrolyte undesirably bypasses the cross flow manifold as described above. The baffles may be formed as part of the ionically resistive element, a membrane frame proximate the ionically resistive element, a membrane frame proximate the anode chamber, a back side insert, or a separate piece of hardware. The baffles may be provided together as a single unit, or may be provided individually. Typically, the baffles are oriented perpendicular to the direction of cross flowing electrolyte within the cross flow manifold. In cases where the ionically resistive element or a membrane frame includes a series of linear ribs, the linear ribs and baffles may be oriented such that their lengths are parallel to one another. The baffles may also be referred to as walls.

FIG. 5A illustrates an electroplating apparatus that includes a series of baffles 130 in the ionically resistive element manifold 111. The baffles 130 divide the ionically resistive element manifold 111 into several baffle regions 139. In this example, the baffles 130 are formed by the ionically resistive element 107. The baffles 130 extend vertically down from the main body of the ionically resistive element 107, and also extend into/out of the page. In FIG. 5A, the baffles 130 are shaped and spaced to correspond with the ribs 150 on the upper surface of the ionically resistive element 107, though this is not always the case. The baffles 130 may mate with the anode chamber membrane frame 106. During electroplating, the baffles 130 prevent electrolyte from flowing across the electroplating cell (e.g., left-to-right in FIG. 5A) within the ionically resistive element manifold 111. The result is that a greater proportion of the electrolyte delivered to the side inlet 113 is maintained within the cross flow manifold 110, rather than leaking through the ionically resistive element 107 into the ionically resistive element manifold 111 (as would occur if no baffles were present).

In some cases, only a single baffle is used. The baffle may be located near the side inlet, near the center of the substrate, or near the side outlet. In other cases, two, three, four, five, six, or more baffles may be used. The baffles may be spaced evenly or unevenly. In some cases, the distance between adjacent baffles is between about 10 mm-30 mm, or between about 5 mm-150 mm. The width of each baffle (measured left-to-right in FIG. 5A) may be between about 0.5 mm-1.5 mm, or between about 0.25 mm-3 mm. The baffles may have different dimensions, e.g., such that each baffle matches the shape of the ionically resistive element manifold at the position where it is located. In some cases, the baffles extend all the way to the edges of the ionically resistive element (or membrane or membrane frame, if present directly below the ionically resistive element), all the way to the edges of the membrane frame that defines the anode chamber, and all the way across the electroplating cell. Such baffles provide a very high resistance to flow, as there is no space for the electrolyte to squeeze around the baffles.

Figure 5D:
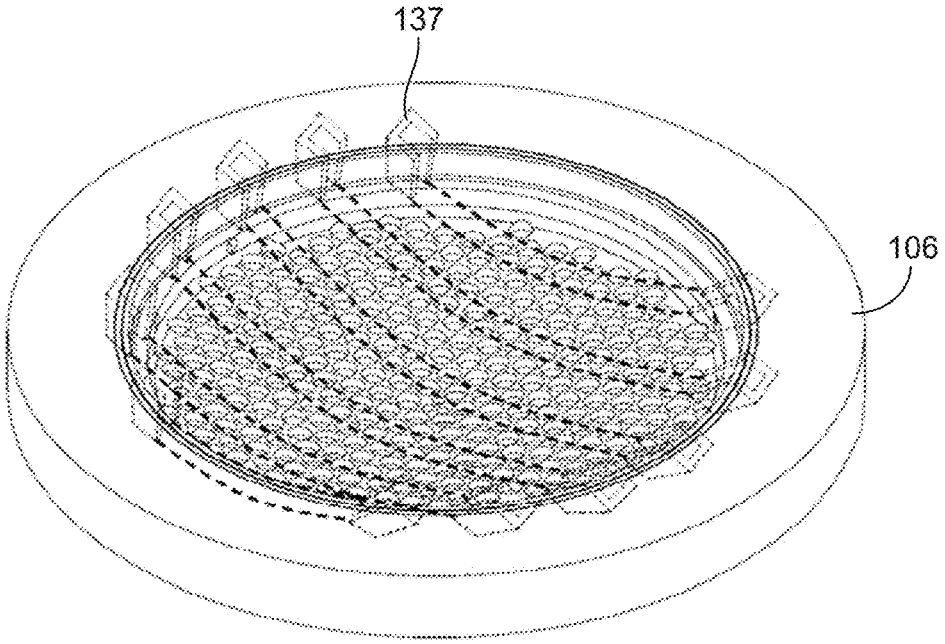
FIG. 5D shows a membrane frame that defines an anode chamber, where the membrane frame includes recesses for accommodating the edges of baffles.
Figure 5E:
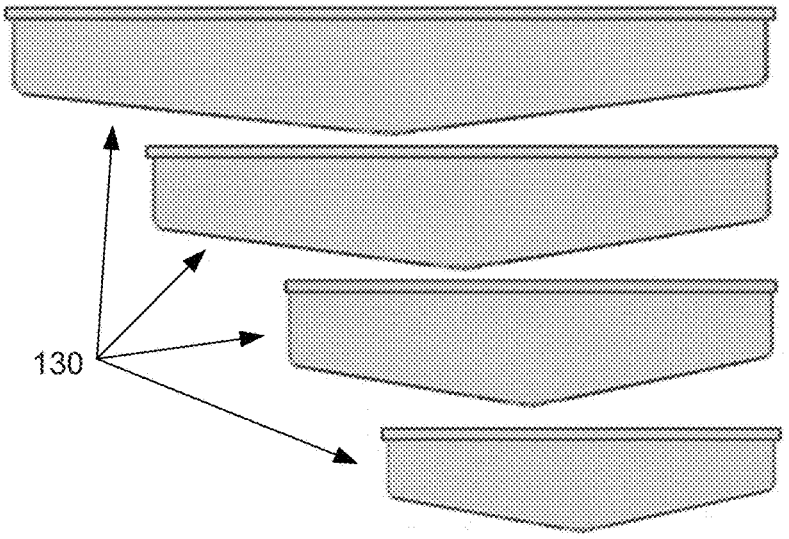
FIG. 5E shows a number of baffles implemented as standalone pieces according to certain embodiments.

In other cases, the baffles may be less extensive. For instance, they may not extend all the way down to the membrane frame defining the anode chamber, and/or they may not extend all the way out to the edges of the electroplating chamber. In these cases, the baffles provide a resistance to electrolyte flow, but not as great as the previous example. In some embodiments, it is desirable to provide increased convection/irrigation on a membrane near the anode chamber. FIG. 5G depicts an electroplating apparatus similar to the one shown in FIG. 5A, except that the baffles 130 do not reach the anode chamber membrane frame 106. When a gap is provided between the edge of each baffle 130 and the anode chamber membrane frame 106, electrolyte penetrates the gap to move from one baffle region 139 to another, as shown by the curved arrows. Because each gap is positioned near the membrane 105, electrolyte traveling through each gap acts to irrigate the membrane 105 as it travels from one baffle region 139 to another. This technique may improve electroplating results, and may extend the useful lifetime of each membrane 105.

FIGS. 5B and 5C illustrate a back side insert 135 including a series of baffles 130. FIG. 5B shows the back side insert 135 looking from below, and FIG. 5C shows the back side insert 135 looking from above, where the back side insert 135 is installed below ionically resistive element 107 and above anode chamber membrane frame 106. The term back side insert refers to a piece of hardware installed proximate the back side (e.g., underside/lower side) of an ionically resistive element. The back side insert may be clamped between the anode chamber membrane frame 106 and the ionically resistive element 107.

In certain implementations, the membrane frame that supports the membrane defining the anode chamber may be modified to mate with the baffles. FIG. 5D depicts an anode chamber membrane frame 106 having a series of recesses 137 formed therein. The recesses 137 are each shaped and sized to receive an edge of a baffle 130. FIG. 5E depicts example baffles 130 that are implemented as individual standalone pieces. These baffles 130 (or others) can be supported by the recesses 137 in the anode chamber membrane frame 106. Similar recesses 137 may be provided on the lower surface of the ionically resistive element, or on the lower surface of a membrane frame (e.g., membrane frame 121 as shown in FIG. 3A or 4A) to support the upper edge of the baffles 130.

Figure 5F:
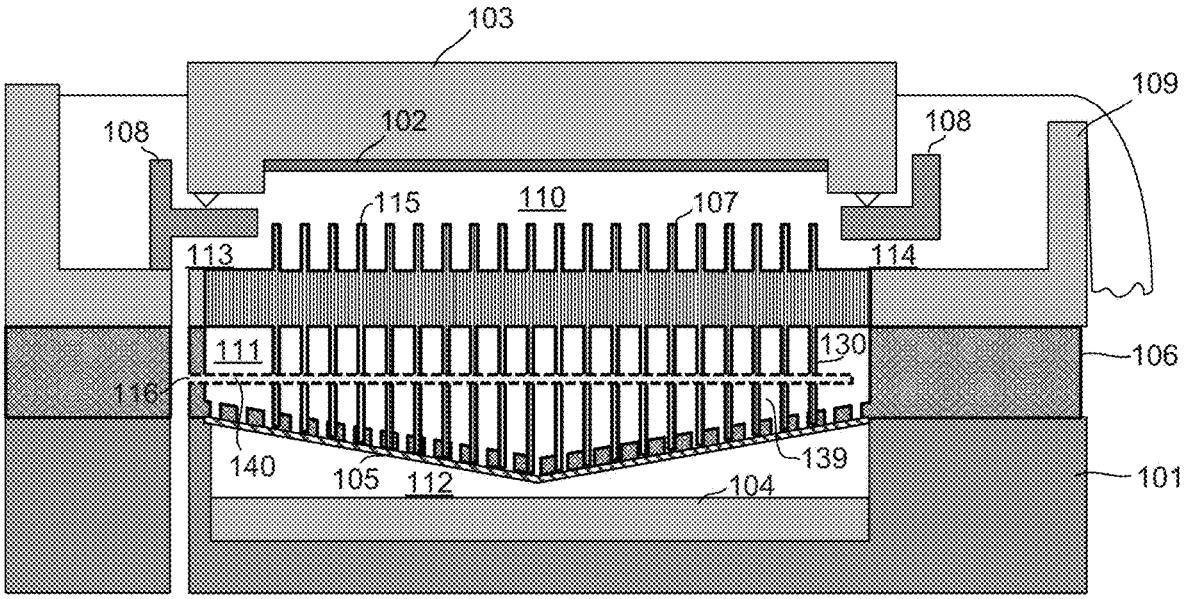
FIG. 5F shows an electroplating apparatus similar to that shown in FIG. 5A, with the addition of a fluted inlet that delivers electrolyte to each baffle region.
Figure 5G:
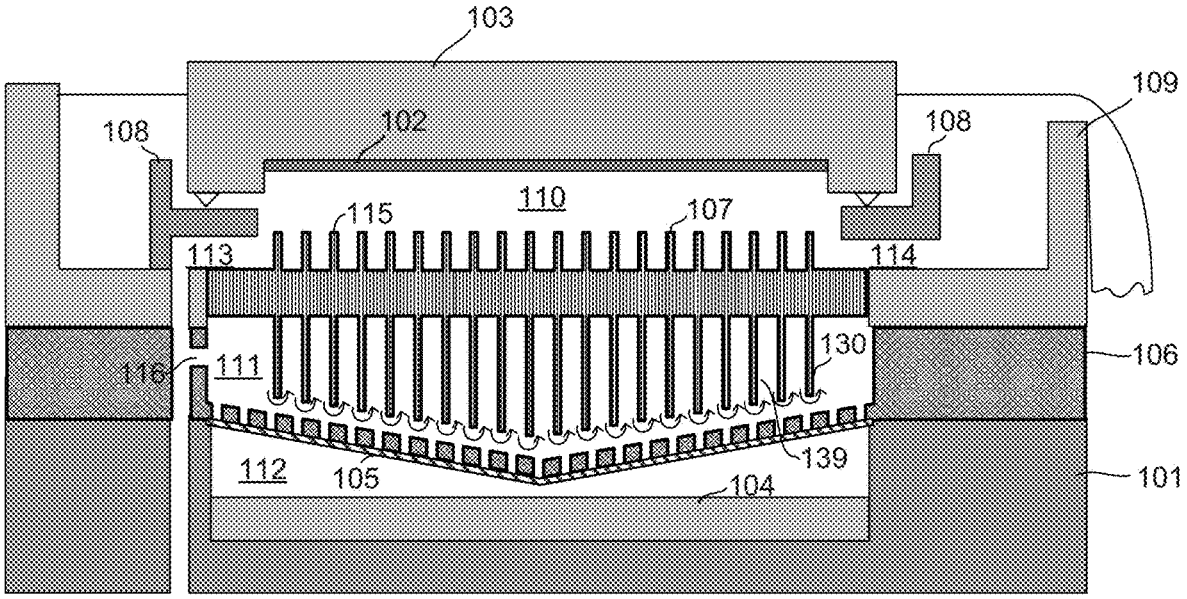
FIG. 5G shows an electroplating apparatus similar to that shown in FIG. 5A, where the baffles do not extend all the way to the membrane frame, such that electrolyte can travel under the baffles to irrigate the membrane that defines the anode chamber.

FIG. 5F depicts an electroplating apparatus similar to that shown in FIG. 5A, with the addition of a fluted inlet 140 connected to inlet 116 that provides electrolyte to each baffle region 139. The fluted inlet 140 may deliver electrolyte upward toward the ionically resistive element 107, downward toward membrane 105, at an angle toward baffles 130, or some combination thereof. In some cases, electrolyte delivered through the fluted inlet 140 acts to irrigate the membrane 105 near the anode chamber 112. The fluted inlet 140 also acts to increase convection/circulation in the various baffle regions 139 of the ionically resistive element manifold 111.

In some embodiments the baffles in the ionically resistive element manifold may be provided as part of the anode chamber membrane frame. In such cases, the anode chamber membrane frame may be referred to as a flow focusing membrane frame.

Figure 5H:
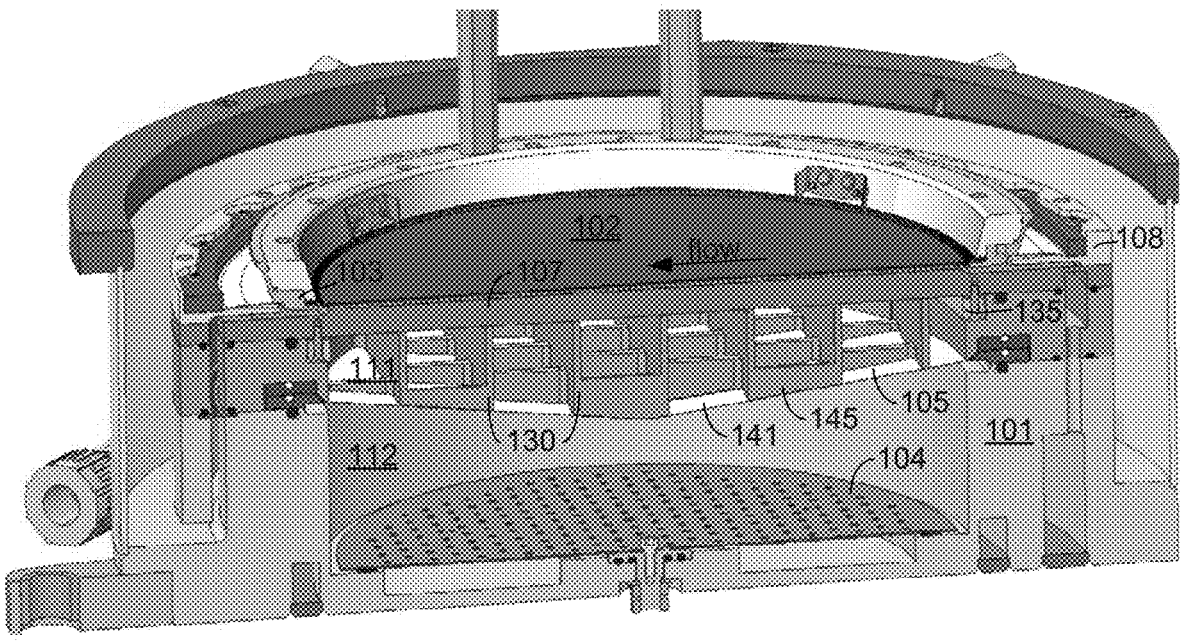
FIG. 5H illustrates an embodiment where baffles are provided in the ionically resistive element manifold, where the baffles are formed as part of an anode chamber membrane frame, also referred to as a flow focusing membrane frame.

FIG. 5H depicts a portion of an electroplating apparatus 101 where a flow focusing membrane frame 145 is adapted to include baffles 130. The baffles 130 extend vertically within the ionically resistive element manifold 111, between the ionically resistive element 107 and the membrane 105 that is positioned directly below the flow focusing membrane frame 145. As described above, the baffles 130 are typically oriented such that their length is perpendicular to the direction of cross flowing electrolyte in the cross flow manifold. While not specifically labeled in FIG. 5H for the sake of clarity, it is understood that the cross flow manifold is positioned below the substrate 102 and above the ionically resistive element 107.

In the example of FIG. 5H, adjacent baffles 130 are connected to one another with support members. In this example, the support members extend all the way down to the membrane 105, but do not extend all the way up to the ionically resistive element 107. In other cases, the support members may extend all the way up to the ionically resistive element 107, and/or may not extend all the way down to the membrane 105. In FIG. 5H, the membrane 105 is oriented in a cone-shape, with the tip of the cone pointing downward at the center of the membrane 105. The bottom surfaces of the baffles 130 and support members are slanted such that they match the shape of the membrane 105.

Openings 141 are defined in the flow focusing membrane frame 145, between adjacent baffles 130 and support members. The openings 141 can be of various shapes and sizes, as desired for a particular application. In the embodiment of FIG. 5H, the openings 141 are rectangular when viewed from above.

FIG. 5H also depicts the anode 104 positioned in the anode chamber 112, and the substrate 102 positioned on the substrate holder 103. The substrate holder 103 is shown in a plating position, but can be raised upwards to load/unload substrates. When in the plating position, as shown, the substrate holder 103 is proximate the front side insert 108. The front side insert 108 may be positioned at least partially radially outside of the substrate holder 103, as shown. In this example, the back side insert 135 is ring-shaped, and approximately coextensive with the substrate holder 103, its diameter being approximately equal to the diameter of the ionically resistive element manifold 111. The back side insert 135 is positioned below the ionically resistive element 107, radially interior of an upper portion of the flow focusing membrane frame 145. The back side insert 135 may be used for current shielding.

Figure 5I:
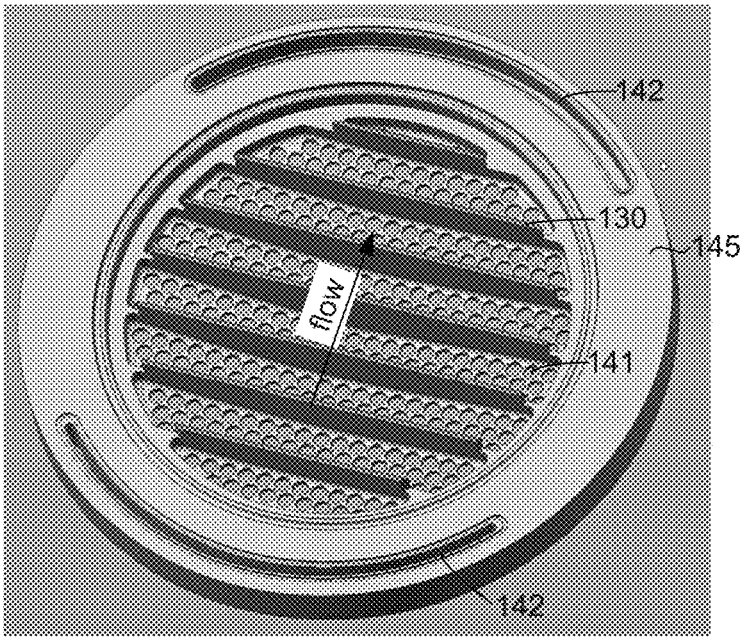
FIG. 5I depicts a view of an anode chamber membrane frame that includes baffles according to one embodiment.

FIG. 5I illustrates a flow focusing membrane frame 145 similar to the one shown in FIG. 5H. In this example, the openings 141 in the flow focusing membrane frame 145 are circular and are oriented in a honeycomb pattern. The baffles 130 are shaped to extend vertically from the ionically resistive element 107 to the membrane 105, as shown in FIG. 5H. FIG. 5I also depicts two arc-shaped openings 142 in the peripheral region of the flow focusing membrane frame 145. The arc-shaped openings 142 may be used to route electrolyte in some cases.

In certain cases, the baffles of the flow focusing membrane frame do not extend all the way across the width of the ionically resistive element manifold. One benefit of this configuration is that a single flow focusing membrane frame can be used to electroplate different substrates with different back side inserts. For example, the back side insert may be designed to have a particular geometry (e.g., inner diameter) for a particular application. Different applications may utilize back side inserts of different sizes. The flow focusing membrane frame can be designed to interchangeably mate with various back side inserts to maximize the usefulness of the flow focusing membrane frame.

Figure 5J:
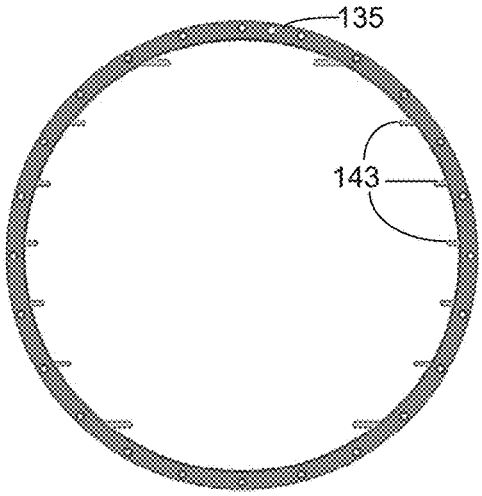
FIGS. 5J and 5K depict back side inserts having protrusions configured to mate with the edges of baffles according to certain embodiments.
Figure 5K:
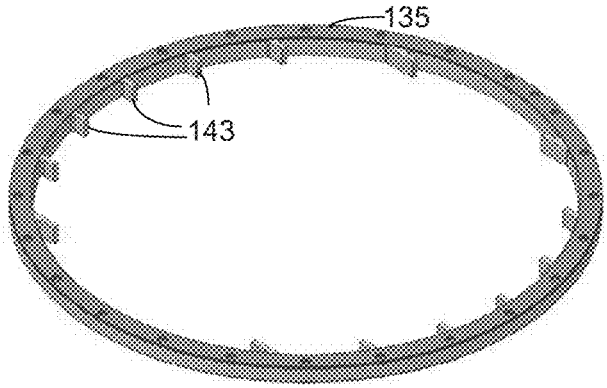
Figure 5L:
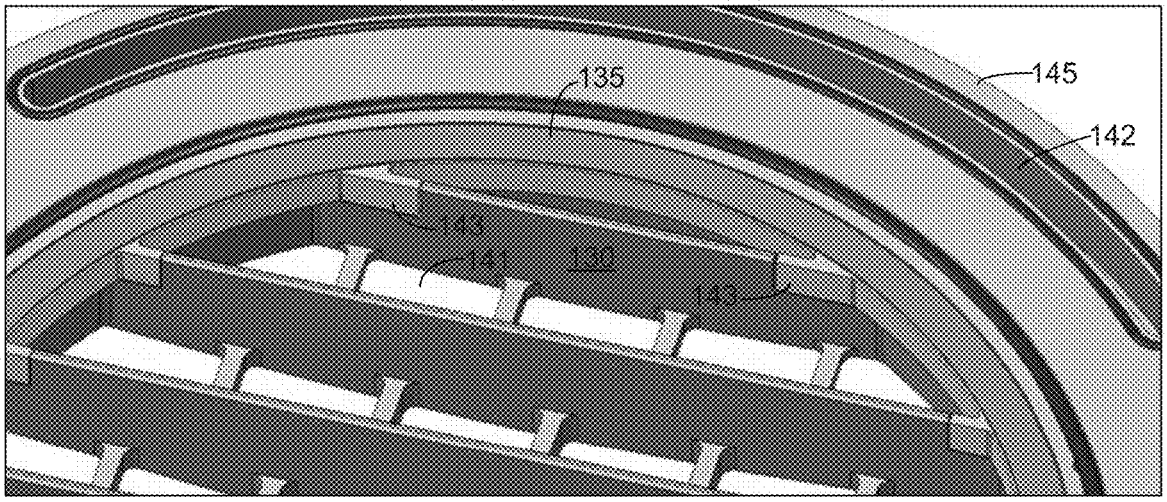
FIG. 5L shows a back side insert mated with an anode chamber membrane frame according to certain embodiments.

FIGS. 5J and 5K present different views of a back side insert 135 according to certain implementations. The back side insert 135 includes a series of protrusions 143. The protrusions 143 are oriented to mate with the edges of the baffles 130 of the flow focusing membrane frame 145, as shown in FIG. 5L. The length of the protrusions 143 may be different for back side inserts 135 of different sizes, thereby allowing each back side insert 135 to interface with a single flow focusing membrane frame 145 for added flexibility and reduced apparatus costs. In order to ensure that different back side inserts 135 can interchangeably mate with the flow focusing membrane frame 145, the upper edges of the baffles 130 may extend to less than the full width of the ionically resistive element manifold, as shown in FIG. 5L. The protrusions 143 on the back side insert 135 can then be positioned proximate the upper edges of the baffles 130, thereby ensuring that the baffles 130 are effectively extended across the full width of the ionically resistive element manifold.

In certain embodiments (not shown), the apparatus may include both (i) a membrane in physical contact with the ionically resistive element (e.g., as described in relation to any of FIGS. 2A-4L), and (ii) one or more baffles (e.g., as described in relation to FIGS. 5A-5G).

Electroplating Systems

The methods described herein may be performed by any suitable system/apparatus. A suitable apparatus includes hardware for accomplishing the process operations and a system controller having instructions for controlling process operations in accordance with the present embodiments. For example, in some embodiments, the hardware may include one or more process stations included in a process tool.

Figure 9:
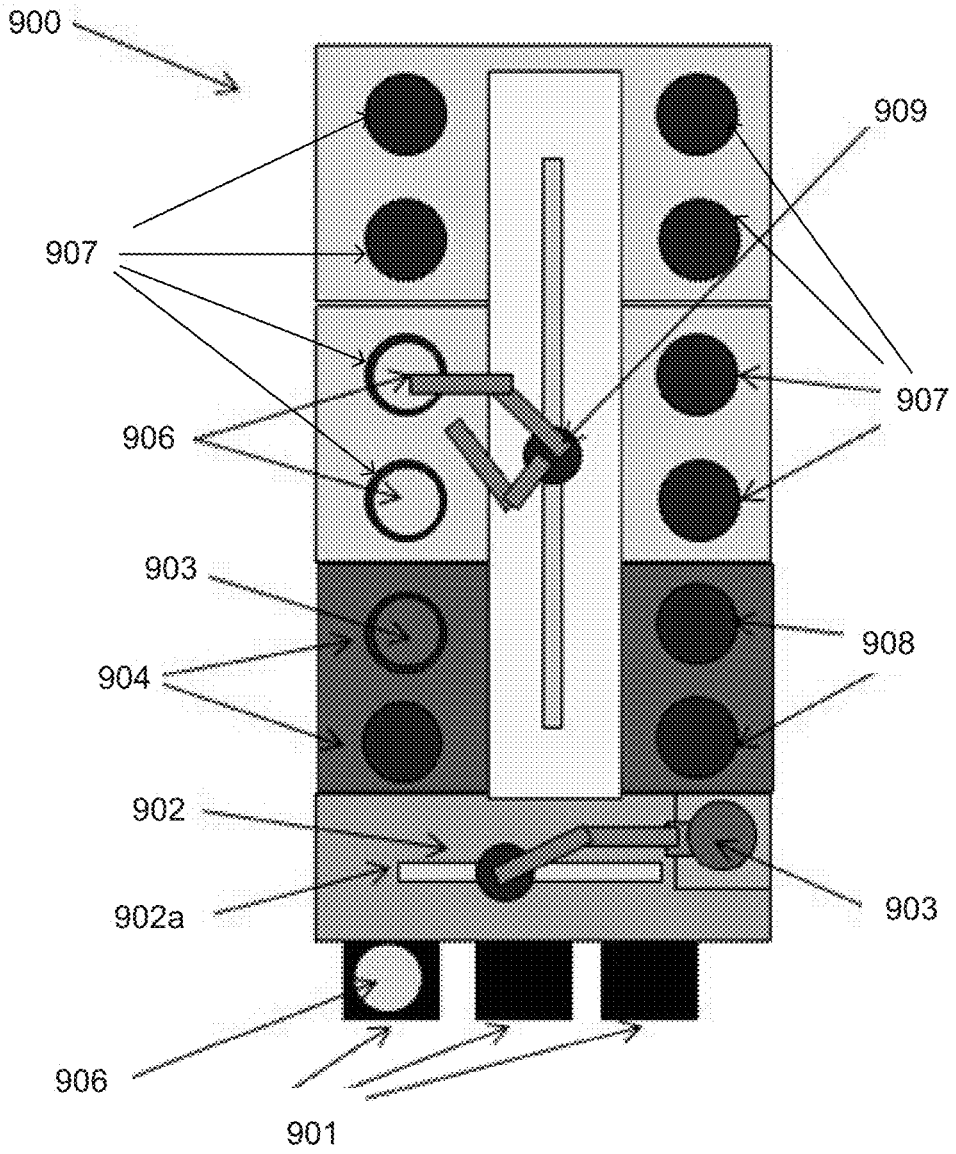
FIG. 9 shows an electroplating apparatus having a number of different electroplating cells and modules therein.

One embodiment of an electrodeposition apparatus 900 is schematically illustrated in FIG. 9. In this embodiment, the electrodeposition apparatus 900 has a set of electroplating cells 907, each containing an electroplating bath, in a paired or multiple "duet" configuration. In addition to electroplating per se, the electrodeposition apparatus 900 may perform a variety of other electroplating related processes and substeps, such as spin-rinsing, spin-drying, metal and silicon wet etching, electroless deposition, pre-wetting and pre-chemical treating, reducing, annealing, electro-etching and/or electropolishing, photoresist stripping, and surface pre-activation, for example. The electrodeposition apparatus 900 is shown schematically looking top down in FIG. 9, and only a single level or "floor" is revealed in the figure, but it is to be readily understood by one having ordinary skill in the art that such an apparatus, e.g., the Lam Sabre™ 3D tool, can have two or more levels "stacked" on top of each other, each potentially having identical or different types of processing stations.

Referring once again to FIG. 9, the substrates 906 that are to be electroplated are generally fed to the electrodeposition apparatus 900 through a front end loading FOUP 901 and, in this example, are brought from the FOUP to the main substrate processing area of the electrodeposition apparatus 900 via a front-end robot 902 that can retract and move a substrate 906 driven by a spindle 903 in multiple dimensions from one station to another of the accessible stations—two front-end accessible stations 904 and also two front-end accessible stations 908 are shown in this example. The front-end accessible stations 904 and 908 may include, for example, pre-treatment stations, and spin rinse drying (SRD) stations. Lateral movement from side-to-side of the front-end robot 902 is accomplished utilizing robot track 902*a*. Each of the substrates 906 may be held by a cup/cone assembly (not shown) driven by a spindle 903 connected to a motor (not shown), and the motor may be attached to a mounting bracket 909. Also shown in this example are the four "duets" of electroplating cells 907, for a total of eight electroplating cells 907. A system controller (not shown) may be coupled to the electrodeposition apparatus 900 to control some or all of the properties of the electrodeposition apparatus 900. The system controller may be programmed or otherwise configured to execute instructions according to processes described earlier herein.

System Controller

In some implementations, a controller is part of a system, which may be part of the above-described examples. Such systems can comprise semiconductor processing equipment, including a processing tool or tools, chamber or chambers, a platform or platforms for processing, and/or specific processing components (a wafer pedestal, a gas flow system, etc.). These systems may be integrated with electronics for controlling their operation before, during, and after processing of a semiconductor wafer or substrate. The electronics may be referred to as the "controller," which may control various components or subparts of the system or systems. The controller, depending on the processing requirements and/or the type of system, may be programmed to control any of the processes disclosed herein, including the delivery of processing gases, temperature settings (e.g., heating and/or cooling), pressure settings, vacuum settings, power settings, radio frequency (RF) generator settings, RF matching circuit settings, frequency settings, flow rate settings, fluid delivery settings, positional and operation settings, wafer transfers into and out of a tool and other transfer tools and/or load locks connected to or interfaced with a specific system.

Broadly speaking, the controller may be defined as electronics having various integrated circuits, logic, memory, and/or software that receive instructions, issue instructions, control operation, enable cleaning operations, enable endpoint measurements, and the like. The integrated circuits may include chips in the form of firmware that store program instructions, digital signal processors (DSPs), chips defined as application specific integrated circuits (ASICs), and/or one or more microprocessors, or microcontrollers that execute program instructions (e.g., software). Program instructions may be instructions communicated to the controller in the form of various individual settings (or program files), defining operational parameters for carrying out a particular process on or for a semiconductor wafer or to a system. The operational parameters may, in some embodiments, be part of a recipe defined by process engineers to accomplish one or more processing steps during the fabrication of one or more layers, materials, metals, oxides, silicon, silicon dioxide, surfaces, circuits, and/or dies of a wafer.

The controller, in some implementations, may be a part of or coupled to a computer that is integrated with, coupled to the system, otherwise networked to the system, or a combination thereof. For example, the controller may be in the "cloud" or all or a part of a fab host computer system, which can allow for remote access of the wafer processing. The computer may enable remote access to the system to monitor current progress of fabrication operations, examine a history of past fabrication operations, examine trends or performance metrics from a plurality of fabrication operations, to change parameters of current processing, to set processing steps to follow a current processing, or to start a new process. In some examples, a remote computer (e.g. a server) can provide process recipes to a system over a network, which may include a local network or the Internet. The remote computer may include a user interface that enables entry or programming of parameters and/or settings, which are then communicated to the system from the remote computer. In some examples, the controller receives instructions in the form of data, which specify parameters for each of the processing steps to be performed during one or more operations. It should be understood that the parameters may be specific to the type of process to be performed and the type of tool that the controller is configured to interface with or control. Thus as described above, the controller may be distributed, such as by comprising one or more discrete controllers that are networked together and working towards a common purpose, such as the processes and controls described herein. An example of a distributed controller for such purposes would be one or more integrated circuits on a chamber in communication with one or more integrated circuits located remotely (such as at the platform level or as part of a remote computer) that combine to control a process on the chamber.

Without limitation, example systems may include a plasma etch chamber or module, a deposition chamber or module, a spin-rinse chamber or module, a metal plating chamber or module, a clean chamber or module, a bevel edge etch chamber or module, a physical vapor deposition (PVD) chamber or module, a chemical vapor deposition (CVD) chamber or module, an atomic layer deposition (ALD) chamber or module, an atomic layer etch (ALE) chamber or module, an ion implantation chamber or module, a track chamber or module, and any other semiconductor processing systems that may be associated or used in the fabrication and/or manufacturing of semiconductor wafers.

As noted above, depending on the process step or steps to be performed by the tool, the controller might communicate with one or more of other tool circuits or modules, other tool components, cluster tools, other tool interfaces, adjacent tools, neighboring tools, tools located throughout a factory, a main computer, another controller, or tools used in material transport that bring containers of wafers to and from tool locations and/or load ports in a semiconductor manufacturing factory.

Additional Embodiments

The various hardware and method embodiments described above may be used in conjunction with lithographic patterning tools or processes, for example, for the fabrication or manufacture of semiconductor devices, displays, LEDs, photovoltaic panels and the like. Typically, though not necessarily, such tools/processes will be used or conducted together in a common fabrication facility.

Lithographic patterning of a film typically comprises some or all of the following steps, each step enabled with a number of possible tools: (1) application of photoresist on a workpiece, e.g., a substrate having a silicon nitride film formed thereon, using a spin-on or spray-on tool; (2) curing of photoresist using a hot plate or furnace or other suitable curing tool; (3) exposing the photoresist to visible or UV or x-ray light with a tool such as a wafer stepper; (4) developing the resist so as to selectively remove resist and thereby pattern it using a tool such as a wet bench or a spray developer; (5) transferring the resist pattern into an underlying film or workpiece by using a dry or plasma-assisted etching tool; and (6) removing the resist using a tool such as an RF or microwave plasma resist stripper. In some embodiments, an ashable hard mask layer (such as an amorphous carbon layer) and another suitable hard mask (such as an antireflective layer) may be deposited prior to applying the photoresist.

In this application, the terms "semiconductor wafer," "wafer," "substrate," "wafer substrate," and "partially fabricated integrated circuit" are used interchangeably. One of ordinary skill in the art would understand that the term "partially fabricated integrated circuit" can refer to a silicon wafer during any of many stages of integrated circuit fabrication thereon. A wafer or substrate used in the semiconductor device industry typically has a diameter of 200 mm, or 300 mm, or 450 mm. Further, the terms "electrolyte," "plating bath," "bath," and "plating solution" are used interchangeably. The detailed description assumes the embodiments are implemented on a wafer. However, the embodiments are not so limited. The work piece may be of various shapes, sizes, and materials. In addition to semiconductor wafers, other work pieces that may take advantage of the disclosed embodiments include various articles such as printed circuit boards, magnetic recording media, magnetic recording sensors, mirrors, optical elements, micro-mechanical devices and the like.

In the above description, numerous specific details are set forth in order to provide a thorough understanding of the presented embodiments. The disclosed embodiments may be practiced without some or all of these specific details. In other instances, well-known process operations have not been described in detail to not unnecessarily obscure the disclosed embodiments. While the disclosed embodiments will be described in conjunction with the specific embodiments, it will be understood that it is not intended to limit the disclosed embodiments.

Unless otherwise defined for a particular parameter, the terms "about" and "approximately" as used herein are intended to mean±10% with respect to a relevant value.

It is to be understood that the configurations and/or approaches described herein are exemplary in nature, and that these specific embodiments or examples are not to be considered in a limiting sense, because numerous variations are possible. The specific routines or methods described herein may represent one or more of any number of processing strategies. As such, various acts illustrated may be performed in the sequence illustrated, in other sequences, in parallel, or in some cases omitted. Likewise, the order of the above described processes may be changed. Certain references have been incorporated by reference herein. It is understood that any disclaimers or disavowals made in such references do not necessarily apply to the embodiments described herein. Similarly, any features described as necessary in such references may be omitted in the embodiments herein.

The subject matter of the present disclosure includes all novel and nonobvious combinations and sub-combinations of the various processes, systems and configurations, and other features, functions, acts, and/or properties disclosed herein, as well as any and all equivalents thereof.

EXPERIMENTAL

Figure 6A:
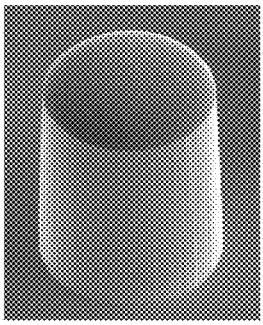
FIGS. 6A and 6B show features plated in an electroplating apparatus as shown in FIG. 1A.
Figure 6B:
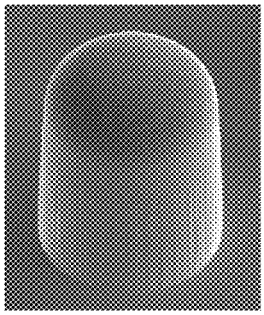

FIGS. 6A and 6B depict features plated in an apparatus as shown in FIGS. 1A-1C. Specifically, FIG. 6A shows a feature plated near the edge of a substrate, while FIG. 6B shows a feature plated near the center of the substrate. The feature in FIG. 6A is noticeably flatter/sharper than the feature in FIG. 6B, which is more domed. Without wishing to be bound by theory or mechanism of action, it is believed that the centrally located feature in FIG. 6B is domed because it experiences relatively low convection during electroplating, as compared to the edge located feature of FIG. 6A.

A number of embodiments described herein were tested by performing a static imprint on a non-patterned substrate having a seed layer of copper thereon. To perform a static imprint, a substrate is loaded into an electroplating apparatus that is filled with an acidic oxygen-rich solution. This solution is flowed through the apparatus in the same way that electrolyte flows through the apparatus during electroplating. The solution dissolves the copper seed layer to some degree, and areas that experience higher convection show a greater degree of etching. No current or potential is applied to the substrate during the static imprint. The substrate is not rotated during the static imprint.

Figure 7A:
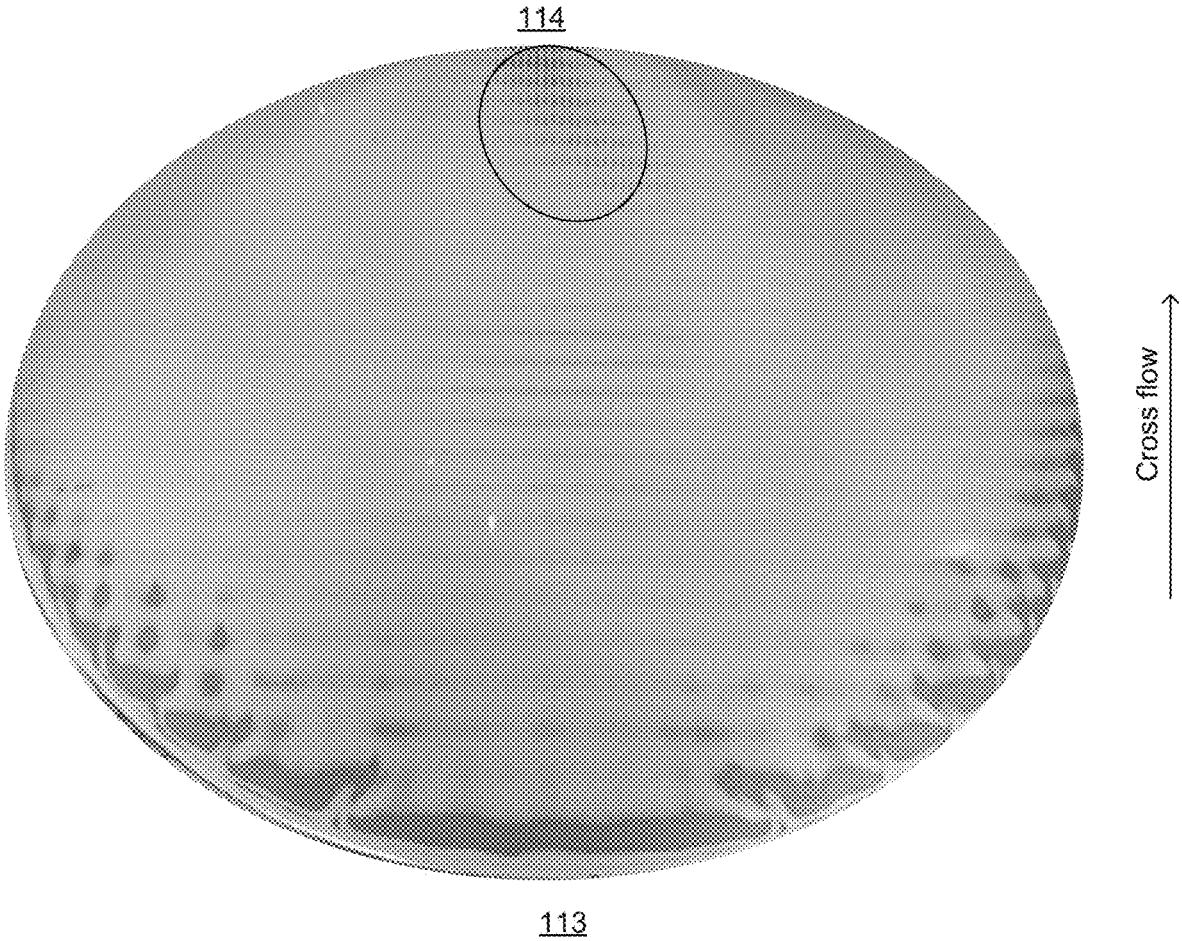
FIGS. 7A-7D show static imprint results taken on substrates processed in various electroplating apparatus as described herein.

FIG. 7A illustrates a static imprint taken on an electroplating apparatus as shown in FIGS. 1A-1C. The region of the substrate shown in the oval is noticeably more etched compared to the rest of the substrate. These results suggest that a portion of the solution delivered through the side inlet 113 is bypassing a large portion of the cross flow manifold 110 by instead flowing through the ionically resistive element into the ionically resistive element manifold 111. The solution travels back up through the ionically resistive element 107 into the cross flow manifold 110 at a region near the side outlet 114, as shown in FIG. 1C. The solution that travels back up through the ionically resistive element 107 impinges on the substrate surface, causing more substantial etching in the oval region compared to other regions of the substrate.

Figure 7B:
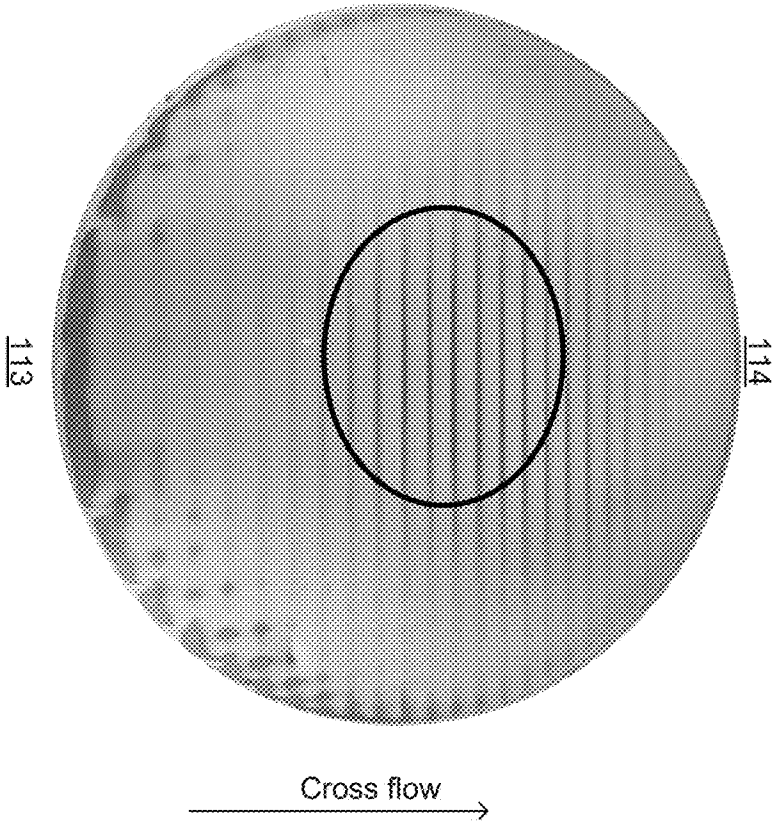

FIG. 7B illustrates a static imprint taken on an electroplating apparatus as shown in FIG. 3A. The apparatus included a membrane 120 positioned directly below and in physical contact with the ionically resistive element 107, as well as a membrane frame 121 that was ring-shaped and supported the membrane 120 at its periphery. In this example, there was no evidence of solution jetting upward through the ionically resistive element 107 near the side outlet 114. Instead, the center of the substrate (circled)

shows relatively greater etching compared to the edges of the substrate, indicating improved cross flow at the center of the substrate. These results suggest that the use of a membrane proximate the ionically resistive element can substantially prevent the flow bypass problems described herein, and can substantially improve cross flow near the center of the substrate.

Figure 7C:
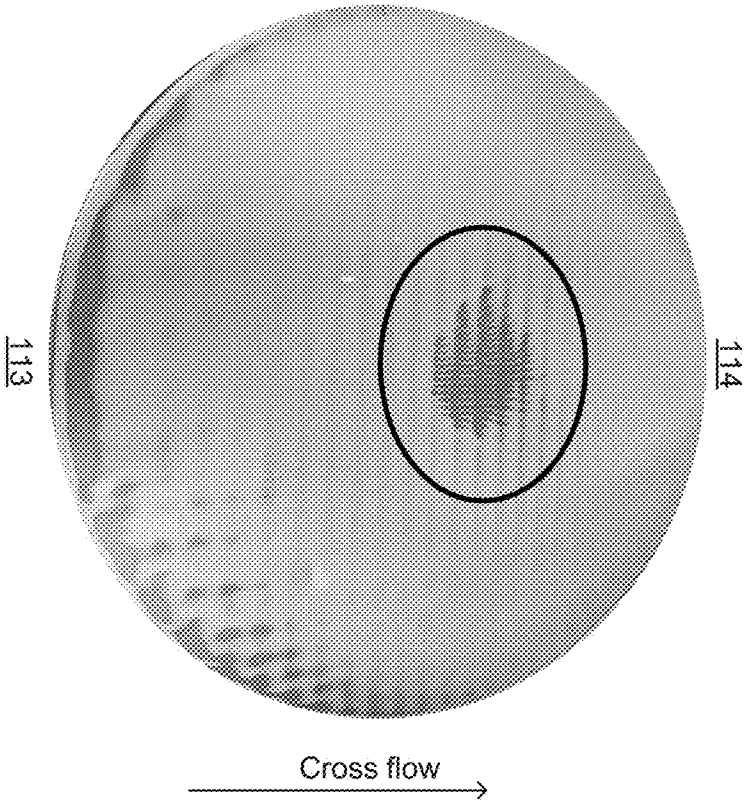

FIG. 7C presents a static imprint taken on an electroplating apparatus as shown in FIG. 4A, using the membrane 120 shown in FIG. 4H (this membrane includes a first opening near the side inlet 113 and a second opening near the center of the substrate/membrane 120). In this example, there is no evidence of solution jetting upward through the ionically resistive element 107 near the side outlet 114. The results do show substantial jetting of solution near the center of the substrate 102 (circled), due to solution being routed down through the first opening in the membrane 120 (the opening near the side inlet 113) and then back up through the second opening in the membrane 120 (the opening near the center of the substrate/membrane 120). These results suggest that the membrane cutouts described herein can be used to route electrolyte to a desired region of the substrate, for example near the center of the substrate where convection is otherwise relatively low.

Figure 7D:
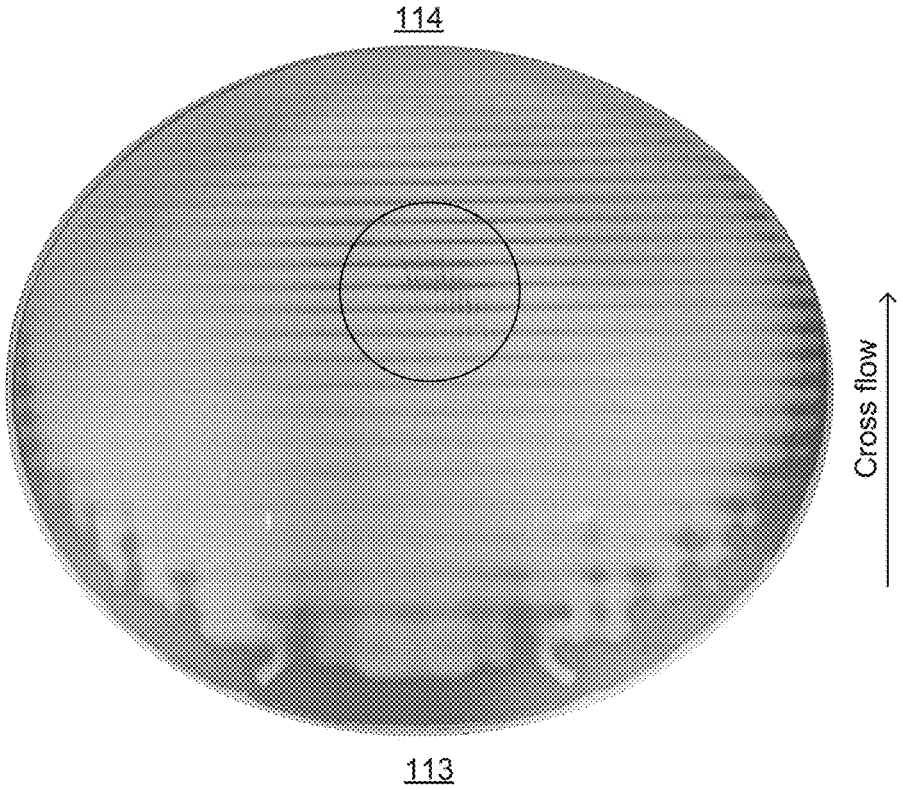

FIG. 7D depicts a static imprint taken on an electroplating apparatus as shown in FIG. 4A, using the membrane 120 shown in FIG. 4B (this membrane includes a single opening that extends from near the side inlet 113 to near the center of the substrate/membrane 120). There is no evidence of solution jetting upward through the ionically resistive element 107 near the side outlet 114. There is some evidence of fluid jetting upward through the ionically resistive element 107 near the center of the substrate/membrane 120 (circled). The jetting is not as substantial as in FIG. 7C. These results suggest that membranes having a single opening can be used to route electrolyte as desired, improving cross flow near the center of the substrate.

Figure 8:
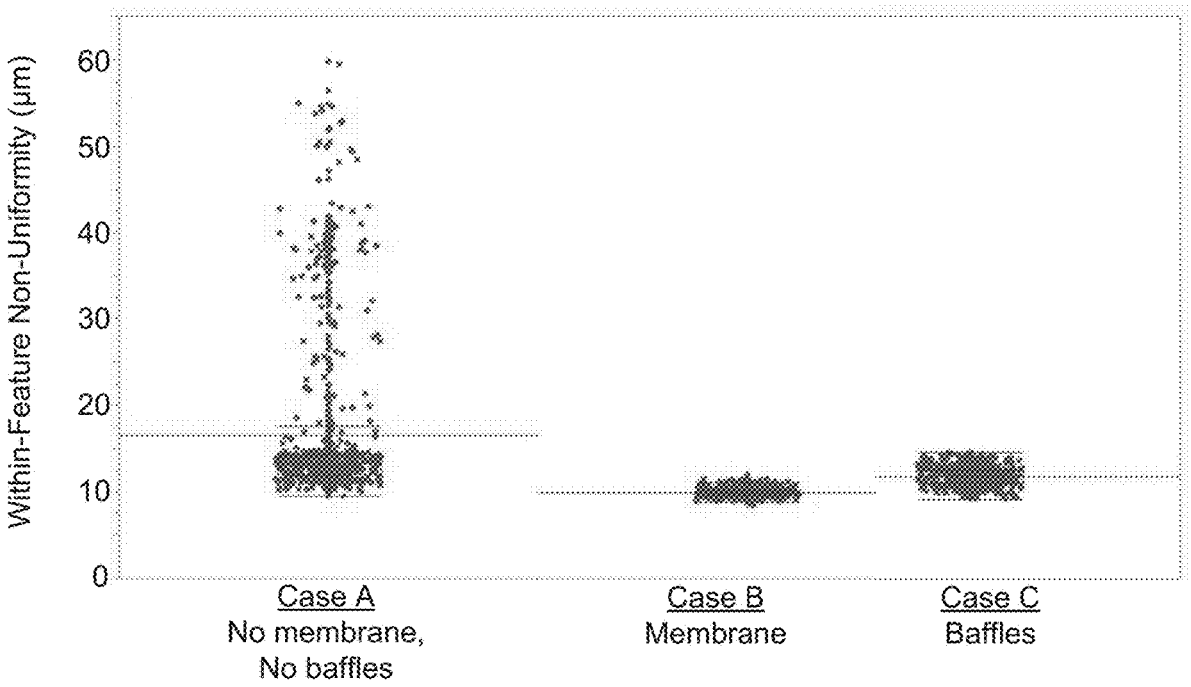
FIG. 8 presents experimental data describing the within-feature non-uniformity for substrates processed in various electroplating apparatus as described herein.

FIG. 8 presents experimental results describing the within-feature non-uniformity for substrates plated in various apparatus described herein. Specifically, case A relates to an apparatus as shown in FIGS. 1A-1C (e.g., an apparatus that does not include baffles or a membrane in contact with the ionically resistive element 107). Case B relates to an apparatus as shown in FIG. 4A, having the membrane 120 shown in FIG. 4B. Case C relates to an apparatus as shown in FIG. 5A, having a series of baffles 130 in the ionically resistive element manifold 111. In case A, where no baffles or membrane proximate the ionically resistive element is provided, the within-feature non-uniformity is quite high (e.g., up to 60 μm) and variable. In case B, where a membrane is provided in contact with the ionically resistive element, the within-feature non-uniformity is much lower (e.g., below about 13 μm), with very low variability. Similarly, in case C, where baffles are provided in the ionically resistive element manifold, the within-feature non-uniformity is fairly low (e.g., below about 15 μm), with very low variability. Case B showed the best results (lowest and least variable non-uniformity), but the results of case C were also very good. These results show that the techniques described herein can be successfully implemented to improve electroplating results, particularly the within-feature non-uniformity.

What is claimed is:

1. An electroplating apparatus comprising:

(a) a plating chamber configured to contain an electrolyte and an anode while electroplating metal onto a substrate, the substrate being substantially planar;

(b) a substrate holder configured to support the substrate such that a plating face of the substrate is immersed in the electrolyte and separated from the anode during plating;

(c) an ionically resistive element adapted to provide ionic transport through the ionically resistive element during electroplating, wherein the ionically resistive element is a plate comprising a plurality of through-holes;

(d) a cross flow manifold positioned above the ionically resistive element and below the plating face of the substrate, when the substrate is present in the substrate holder;

(e) an anode chamber membrane frame positioned below the ionically resistive element, the anode chamber membrane frame configured to mate with an anode chamber membrane; and (f) an ionically resistive element manifold positioned below the ionically resistive element and above the anode chamber membrane, when present, wherein the ionically resistive element manifold comprises a plurality of baffle regions that are at least partially separated from one another by vertically oriented baffles, wherein each baffle extends from a first region proximate the ionically resistive element to a second region proximate the anode chamber membrane, and wherein the baffles extend linearly across the ionically resistive element manifold in a direction perpendicular to a direction between a side inlet and a side outlet, wherein the side inlet and side outlet are adapted to generate cross-flowing electrolyte in the cross flow manifold during electroplating.

2. The electroplating apparatus of claim 1, further comprising the anode chamber membrane in contact with the anode chamber membrane frame, wherein the anode chamber membrane separates the anode from the substrate during electroplating.

3. The electroplating apparatus of claim 2, wherein an upper region of each baffle is in physical contact with the ionically resistive element or a frame positioned proximate the ionically resistive element.

4. The electroplating apparatus of claim 1, wherein during electroplating, the baffles operate to reduce an amount of electrolyte that travels from the cross flow manifold, through the ionically resistive element, and into the ionically resistive element manifold.

5. The electroplating apparatus of claim 1, wherein the anode chamber membrane frame comprises the baffles.

6. The electroplating apparatus of claim 5, further comprising a back side insert positioned between the ionically resistive element and the anode chamber membrane frame, wherein the back side insert comprises a plurality of protrusions oriented parallel to the baffles and configured to mate with the baffles.

7. The electroplating apparatus of claim 1, wherein the baffles do not extend all the way to the anode chamber membrane frame.

8. The electroplating apparatus of claim 1, wherein the ionically resistive element comprises the baffles.

9. The electroplating apparatus of claim 1, further comprising a back side insert positioned between the ionically resistive element and the anode chamber membrane frame, wherein the back side insert comprises the baffles.

10. The electroplating apparatus of claim 1, wherein the baffles are removable pieces that are not integral with the ionically resistive element, the anode chamber membrane frame, nor a back side insert positioned between the ionically resistive element and the anode chamber membrane frame, and wherein the baffles fit into recesses in at least one of the ionically resistive element, the anode chamber membrane frame, and the back side insert.

11. An electroplating apparatus comprising:

(a) a plating chamber configured to contain an electrolyte and an anode while electroplating metal onto a substrate, the substrate being substantially planar;

(b) a substrate holder configured to support the substrate such that a plating face of the substrate is immersed in the electrolyte and separated from the anode during plating;

(c) an ionically resistive element adapted to provide ionic transport through the ionically resistive element during electroplating, wherein the ionically resistive element is a plate comprising a plurality of through-holes;

(d) a cross flow manifold positioned above the ionically resistive element and below the plating face of the substrate, when the substrate is present in the substrate holder;

(e) a membrane in physical contact with the ionically resistive element, wherein the membrane is adapted to provide ionic transport through the membrane during electroplating, and wherein the membrane is adapted to reduce a flow of electrolyte through the ionically resistive element during electroplating, and wherein the membrane comprises one or more azimuthally non-uniform cutout regions such that the membrane only covers some of the plurality of through-holes in the ionically resistive element.

12. The electroplating apparatus of claim 11, wherein the membrane is planar and is positioned within a plane parallel to the ionically resistive element.

13. The electroplating apparatus of claim 11, wherein the membrane comprises a first cutout region positioned near a center of the ionically resistive element.

14. The electroplating apparatus of claim 13, wherein the membrane comprises a second cutout region positioned near a side inlet to the cross flow manifold.

15. The electroplating apparatus of claim 11, wherein the membrane is positioned below the ionically resistive element.

16. The electroplating apparatus of claim 11, wherein the membrane is positioned above the ionically resistive element.

17. The electroplating apparatus of claim 11, further comprising a membrane frame configured to position the membrane in physical contact with the ionically resistive element.

18. The electroplating apparatus of claim 17, wherein the membrane is positioned above the ionically resistive element, wherein the membrane frame is positioned above the membrane, and wherein the membrane frame comprises a first set of ribs that are linear and parallel to one another, and extend in a direction perpendicular to a direction of cross flowing electrolyte within the cross flow manifold.

19. An electroplating apparatus comprising:

(a) a plating chamber configured to contain an electrolyte and an anode while electroplating metal onto a substrate, the substrate being substantially planar;

(b) a substrate holder configured to support the substrate such that a plating face of the substrate is immersed in the electrolyte and separated from the anode during plating;

(c) an ionically resistive element adapted to provide ionic transport through the ionically resistive element during electroplating, wherein the ionically resistive element is a plate comprising a plurality of through-holes;

(d) a cross flow manifold positioned above the ionically resistive element and below the plating face of the substrate, when the substrate is present in the substrate holder;

(e) a membrane in physical contact with the ionically resistive element, wherein the membrane is adapted to provide ionic transport through the membrane during electroplating, and wherein the membrane is adapted to reduce a flow of electrolyte through the ionically resistive element during electroplating and (f) a membrane frame configured to position the membrane in physical contact with the ionically resistive element, wherein the membrane is positioned above the ionically resistive element, wherein the membrane frame is positioned above the membrane, and wherein the membrane frame comprises a first set of ribs that are linear and parallel to one another, and extend in a direction perpendicular to a direction of cross flowing electrolyte within the cross flow manifold.

20. An electroplating apparatus comprising:

(a) a plating chamber configured to contain an electrolyte and an anode while electroplating metal onto a substrate, the substrate being substantially planar;

(b) a substrate holder configured to support the substrate such that a plating face of the substrate is immersed in the electrolyte and separated from the anode during plating;

(c) an ionically resistive element adapted to provide ionic transport through the ionically resistive element during electroplating, wherein the ionically resistive element is a plate comprising a plurality of through-holes;

(d) a cross flow manifold positioned above the ionically resistive element and below the plating face of the substrate, when the substrate is present in the substrate holder;

(e) an anode chamber membrane frame positioned below the ionically resistive element, the anode chamber membrane frame configured to mate with an anode chamber membrane; and (f) an ionically resistive element manifold positioned below the ionically resistive element and above the anode chamber membrane, when present, wherein the ionically resistive element manifold comprises a plurality of baffle regions that are at least partially separated from one another by vertically oriented baffles, wherein each baffle extends from a first region proximate the ionically resistive element to a second region proximate the anode chamber membrane, wherein the anode chamber membrane frame comprises the baffles.

* * * * *